US005286615A

United States Patent [19]

Shuto et al.

[11] Patent Number: 5,286,615

[45] Date of Patent: Feb. 15, 1994

[54] SILVER HALIDE COLOR PHOTOGRAPHIC MATERIAL

[75] Inventors: Sadanobu Shuto; Akio Mitsui, both of Kanagawa, Japan

[73] Assignee: Fuji Photo Film Co., Ltd., Kanagawa, Japan

[21] Appl. No.: 776,110

[22] Filed: Oct. 15, 1991

[30] Foreign Application Priority Data

Oct. 15, 1990 [JP] Japan ..... 2-275682
Oct. 25, 1990 [JP] Japan ..... 2-287600

[51] Int. Cl.[5] ..... G03C 1/46

[52] U.S. Cl. ..... 430/505; 430/504; 430/544; 430/551; 430/957; 430/379

[58] Field of Search ..... 430/505, 504, 544, 551, 430/957, 379

[56] References Cited

U.S. PATENT DOCUMENTS

| | | | |
|---|---|---|---|
| 4,388,401 | 6/1983 | Hasebe et al. | 430/505 |
| 4,652,515 | 3/1987 | Ogawa et al. | 430/505 |
| 4,770,982 | 9/1988 | Ichijima et al. | 430/505 |

FOREIGN PATENT DOCUMENTS

| | | | |
|---|---|---|---|
| 0167168 | 8/1986 | European Pat. Off. . | |
| 0270351 | 6/1988 | European Pat. Off. . | |
| 0440195 | 8/1991 | European Pat. Off. | 430/957 |
| 0250433 | 10/1987 | Japan | 430/544 |
| 0202744 | 8/1988 | Japan | 430/544 |
| 0000546 | 1/1989 | Japan | 430/957 |
| 64546 | 1/1989 | Japan | 430/957 |

OTHER PUBLICATIONS

Research Disclosure, No. 188, Item 18813, p. 673, Dec. 1979.

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide color photographic material comprises a support, a blue sensitive layer, a green sensitive layer and a red sensitive layer and at least one non-light-sensitive layer. The non-light-sensitive layer is an intermediate layer arranged between the silver halide emulsion layers. According to the present invention, the non-light-sensitive intermediate layer contains a compound represented by the formula (1a) or (1b):

(1a)

(1b)

in which $R^{12}$ is an aliphatic group, an aromatic group or a heterocyclic group; M is —CO—, —$SO_2$—, —N($R^{15}$)CO—, —OCO— or —N($R^{15}$)$SO_2$—; each of $R^{14}$, $R^{15}$ and $R^{24}$ independently is hydrogen, an alkyl group or an aryl group; L is a divalent linking group necessary for forming a 5, 6 or 7-membered ring; each of $R^{11}$, $R^{13}$ and $R^{21}$ independently is hydrogen or a substituent group of the hydroquinone nucleus; Time is a group which is released from the oxidation product of the hydroquinone nucleus to further release X; X is a development inhibitor; and t is 0 or 1. It is preferred that M is—$SO_2$—, —N($R^{15}$)CO—, —OCO— or —N($R^{15}$)$SO_2$—.

12 Claims, 2 Drawing Sheets

SILVER HALIDE COLOR PHOTOGRAPHIC MATERIAL

FIELD OF THE INVENTION

The present invention relates to a silver halide color photographic material, and particularly relates to a silver halide color reversal photographic material improved in the color and sharpness of an image.

BACKGROUND OF THE INVENTION

The silver halide color photographic materials usually comprises a support, a blue sensitive layer, a green sensitive layer and a red sensitive layer. In the image formation, the photographic material is imagewise exposed to light with respect to a multicolor object, and the silver halide is color-developed to form a color image of cyan, magenta, yellow or other colors.

A DIR (development inhibitor releasing) coupler has been known as an additive of a color negative film. A development inhibitor is released from the coupler in the color development process of a color photographic material. Using the DIR coupler, the sharpness of the image is improved by an edge effect, which is caused by the difference in the density of the released development inhibitor. The DIR coupler is effective in a color developing process of a color negative film or a color paper. However, the effect of the DIR coupler cannot be expected in other color photographic materials such as a color reversal film, a color reversal paper, and a black and white photographic material, since the main process in the image formation of these photographic materials is a black and white development.

A DIR-hydroquinone which releases a development inhibitor in the black and white development process has been known (cf., U.S. Pat. No. 3,364,022 and No. 3,379,529, and Japanese Patent Provisional Publications No. 50(1975)-62435, No. 50(1975)-133833, No. 51(1976)-51941, No. 50(1975)-119631, No. 52(1977)-57828, No. 62(1987)-103639 and No. 62(1987)-251746). The edge effect in the black and white development process can be obtained by the DIR-hydroquinone.

Further, Japanese Patent Provisional Publication No. 64(1989)-546 describes an image forming method improved in sharpness and graininess of the image. This method contains a black and white development process, and uses a silver halide photographic material containing a DIR-hydroquinone in a hydrophilic colloidal layer not containing silver halide.

However, these known DIR-hydroquinones are insufficient for increasing the sharpness of the image Further, the color reproducibility of the obtained image is also insufficient in the case that these DIR-hydroquinones are used.

SUMMARY OF THE INVENTION

A new DIR-hydroquinone represented by the following formula (1a) or (1b) has recently been proposed in European Patent Publication No. 0440195 published on Aug. 7, 1991. The European Patent Publication describes that the DIR-hydroquinone is contained in a silver halide emulsion layer, which is a common arrangement of a DIR-hydroquinone. This DIR-hydroquinone is excellent in the effect of increasing the sharpness of the image. However, the color reproducibility of the obtained image is still insufficient even if this DIR-hydroquinone is used.

An object of the present invention is to provide a silver halide color photographic material improved in the sharpness and the color reproducibility of the image.

Another object of the invention is to provide a photographic material wherein the inter image effect is improved.

A further object of the invention is to provide a photographic material which forms a clear image even if the processing conditions are changed.

A furthermore object of the present invention is to provide a photographic material which forms a clear image even if the processing conditions are changed even in a rapid development process.

A still further object of the invention is to provide a photographic material improved in the preservability of the material or the coating solution thereof.

There is provided by the present invention a silver halide color photographic material comprising a support, a blue sensitive layer, a green sensitive layer and a red sensitive layer and at least one non-light-sensitive layer, said non-light-sensitive layer being an intermediate layer arranged among the blue, green and red sensitive layers, wherein at least one of the non-light-sensitive intermediate layer contains a compound represented by the formula (1a) or (1b):

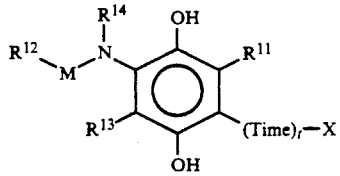

(1a)

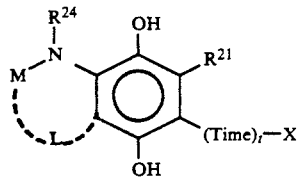

(1b)

in which $R^{12}$ is an aliphatic group, an aromatic group or a heterocyclic group; M is —CO—, —$SO_2$—, —N($R^{15}$)CO—, —OCO— or —N($R^{15}$)$SO_2$—; each of $R^{14}$, $R^{15}$ and $R^{24}$ independently is hydrogen, an alkyl group or an aryl group; L is a divalent linking group necessary for forming a 5, 6 or 7-membered ring; each of $R^{11}$, $R^{13}$ and $R^{21}$ independently is hydrogen or a substituent group of the hydroquinone nucleus; Time is a group which is released from the oxidation product of the hydroquinone nucleus to further release X; X is a development inhibitor; and t is 0 or 1.

The present inventors have surprisingly found that the DIR-hydroquinone represented by the formula (1a) or (1b) is advantageously contained in the non-light-sensitive intermediate layer. Using this arrangement, both of the sharpness and the color reproducibility are greatly improved. Accordingly, the silver halide color photographic material of the present invention forms a clear image improved in the sharpness and the color reproducibility.

In the photographic material of the present invention, the inter image effect is improved. There is difference between a color image formed by a multicolor exposure and that formed by a single-color exposure. This difference is mainly caused by immigration of a developing inhibitor between the silver halide emulsion layers. This phenomenon is referred to as "inter image effect" (cf., Hadson and Horten, *Journal of the Optical Society of America*, vol. 42, No. 9, pp 663-669, 1976). The inter image effect improves the sharpness and the color reproducibility of the image.

Further, the photographic material of the present invention forms a clear image even if the processing conditions are changed. Furthermore, the photographic material of the present invention forms a clear image even if the processing conditions are changed even in a rapid development process. Moreover, the photographic material of the present invention has another advantage of the improved preservability of the material or the coating solution thereof.

DETAILED DESCRIPTION OF THE INVENTION

Figure 1A:
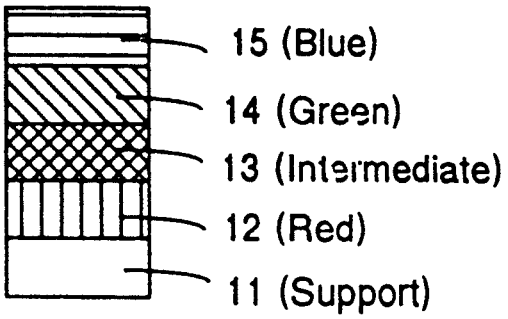
FIGS. 1*a* to 1*d* are sectional views schematically illustrating embodiments of the photographic material of the present invention.

The silver halide color photographic material of the present invention is characterized in that the DIR-hydroquinone represented by the formula (1a) or (1b) is contained in a non-light-sensitive intermediate layer.

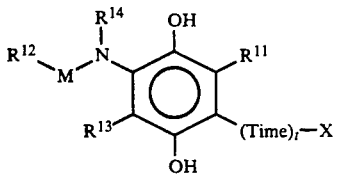

(1a)

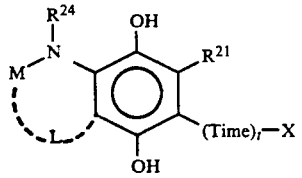

(1b)

In the formula (1a), $R^{12}$ is an aliphatic group, an aromatic group or a heterocyclic group. Examples of the aliphatic group include an alkyl group, an alkenyl group and an alkynyl group. The aliphatic group may have a straight chain, a branched chain or a cyclic chain. The aliphatic group preferably has 1 to 30 carbon atoms. Examples of the aromatic group include phenyl and naphthyl. The aliphatic group preferably has 6 to 30 carbon atoms. The heterocyclic group preferably has a 3-membered to 12-membered heterocyclic ring. The heterocyclic ring preferably contains nitrogen, oxygen or sulfur as the hetero atom.

In the formulas (1a) and (1b), M is —CO—, —$SO_2$—, —N($R^{15}$)CO—, —OCO— or —N($R^{15}$)$SO_2$—. In the case that M in the formula (1a) is —CO—, the aliphatic group represented by $R^{12}$ is neither methyl nor an alkyl group in which an hetero atom is attached to the carbon atom adjacent to M. It is more preferred that M in the formula (1a) is —$SO_2$—, —N($R^{15}$)CO—, —OCO— or —N($R^{15}$)$SO_2$—.

In the formulas (1a) and (1b), each of $R^{14}$, $R^{15}$ and $R^{24}$ independently is hydrogen, an alkyl group or an aryl group. Hydrogen is particularly preferred. The alkyl group may have a straight chain, a branched chain or a cyclic chain. The alkyl group preferably as 1 to 30 carbon atoms. Examples of the aryl group include phenyl and naphthyl. The aryl group preferably has 6 to 30 carbon atoms.

In the formula (1b), L is a divalent linking group necessary for forming a 5, 6 or 7-membered ring. Examples of the linking group include alkylene, alkenylene, arylene, oxyalkylene, oxyarylene, aminoaryleneoxy and an oxygen atom.

In the formulas (1a) and (1b), each of $R^{11}$, $R^{13}$ and $R^{21}$ independently is hydrogen or a substituent group of the hydroquinone nucleus.

In the formulas (1a) and (1b), each of $R^{11}$ and $R^{21}$ preferably is hydrogen, an alkylthio group, an arylthio group, an alkoxy group, an aryloxy group, an amido group, a sulfonamido group, an alkoxycarbonylamino group, an ureido group, a carbamoyl group, an alkoxycarbonyl group, a sulfamoyl group, a sulfonyl group, cyano, an acyl group, a heterocyclic group or a group represented by —$(Time)_t$—X. Each of $R^{11}$ and $R^{21}$ more preferably is hydrogen, an alkylthio group, an alkoxy group, an amido group, a sulfonamido group, an alkoxycarbonylamino group, an ureido group a carbamoyl group, an alkoxycarbonyl group, a sulfamoyl group, cyano or a group represented by —$(Time)_t$—X.

In the formula (1a), $R^{13}$ preferably is hydrogen, an alkylthio group, an arylthio group, an alkoxy group, an aryloxy group, an amido group, a sulfonamido group, an alkoxycarbonylamino group, an ureido group or a group represented by —$(Time)_t$—X. $R^{13}$ more preferably is hydrogen, an alkylthio group, an alkoxy group, an amide group, a sulfonamide group, an alkoxycarbonylamino group, a ureido group or a group represented by —$(Time)_t$—X.

In the formulas (1a) and (1b), Time is a group which is released from the oxidation product of the hydroquinone nucleus to further release X, X is a development inhibitor, and t is 0 or 1.

The group represented by —$(Time)_t$—X is a group which is released as —$(Time)_t$—X only when an oxidation product is formed from the oxidation-reduction nucleus by a cross-oxidation reaction in the development process.

The group represented by Time preferably contains sulfur, nitrogen, oxygen or selenium as a terminal atom which is attached to the hydroquinone nucleus.

Time may be a group capable of releasing X after the development process. Time may have a timing adjusting function. Further, Time may be a coupler which reacts with an oxidation product of a developing agent to release X. Furthermore, Time may be an oxidation-reduction group.

In the case that Time is a group having timing adjusting function, examples thereof are described in U.S. Pat. No. 2,248,962 and No. 4,409,323, U.K. Patent No. 2,096783, U.S. Pat. No. 4,146,396, and Japanese Patent Provisional Publications No. 51(1976)-146828 and No. 57(1982)-56837. Time may be a combination of two or more compounds selected from those described in the above publications.

Preferred examples of the timing adjusting group are described below.

(1) Group Utilizing Cleavage Reaction of Hemiacetal

This group is described in U.S. Pat. No. 4,146,396 and Japanese Patent Provisional Publications No. 60(1985)-249148 and No. 60(1985)-249149. The group is represented by the following formulas. In the following formula, the mark * indicates a position connecting to the left side in the formula (1a) or (1b), and the mark ** indicates a position connecting to the right side in the formula (1a) or (1b).

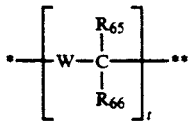

(T-1)

In the formula, W is oxygen, sulfur or —$NR_{67}$—; each of $R_{65}$ and $R_{66}$ is hydrogen or a substituent group; $R_{67}$ is a substituent group; and t is 1 or 2. When t is 2, two of W—$Cl_{65}R_{66}$ may be different from each other. When each of $R_{65}$ and $R_{66}$ is a substituent group, examples of $R_{67}$ include $R_{69}$—, $R_{69}CO$—, $R_{69}SO_2$—, $R_{69}NR_{70}CO$— and $R_{69}NR_{70}SO_2$—. $R_{69}$ is an aliphatic group, an aromatic group or a heterocyclic group, and $R_{70}$ is an aliphatic group, an aromatic group, a heterocyclic group or a hydrogen atom. Each of $R_{65}$, $R_{66}$ and $R_{67}$ is a divalent group, and two or more divalent groups represented by $R_{65}$, $R_{66}$ and $R_{67}$ may be combined with each other to form a cyclic structure.

(2) Group Causing Cleavage Reaction Utilizing Intermolecular Nucleophilic Substitution Reaction This group is described in U.S. Pat. No. 4,248,962. The group is represented by the following formula.

*—Nu—Link—E—** (T-2)

In the formula, the mark * indicates a position connecting to the left side in the formula (1a) or (1b), and the mark  indicates a position connecting to the right side in the formula (1a) or (1b). Nu is a nucleophilic group. Examples of the nucleophilic group include oxygen and sulfur. E is an electrophilic group, which is receives nucleophilic attack from Nu to cleave the bond at the mark . Link is a linking group to make three-dimensional relation between Nu end E so that Nu and E can reacts with each other to perform intermolecular nucleophilic substitution reaction.

(3) Group Causing Cleavage Reaction Utilizing Electron Moving Reaction Based on Conjugation System This group is described in U.S. Pat. No. 4,409,323 and No. 4,421,845. The group is represented by the following formula.

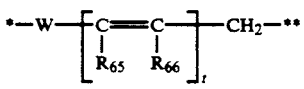

(T-3)

In the formula, the mark *, the mark **, W, $R_{65}$, $R_{66}$ and t have the same meanings as defined on the formula (T-1).

(4) Group Utilizing Cleavage Reaction Caused by Hydrolysis of Ester

The group is a linking group described in West German Patent Publication No. 2,626,315. Examples of the group are represented by the following formulas. In the following formulas, the mark * and the mark ** have the same meanings as defined on the formula (T-1).

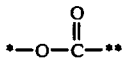

(T-4)

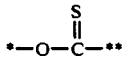

(T-5)

(5) Group Utilizing Cleavage Reaction of Iminoketal

The group is a linking group described in U.S. Pat. No. 4,546,073. The group is represented by the following formula.

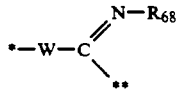

(T-6)

In the formula, the mark *, the mark ** and W have the same meanings as defined in the formula (T-1), and $R_{68}$ has the same meaning as that of $R_{67}$.

When Time is a coupler, preferred examples of the coupler are represented by the following formulas (C-1) to (C-4).

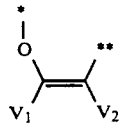

(C-1)

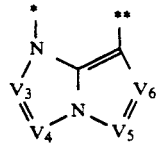

(C-1)

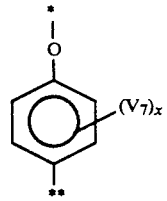

(C-3)

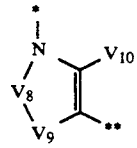

(C-4)

In the formulas, each of $V_1$ and $V_2$ is a substituent group; each of $V_3$, $V_4$, $V_5$ and $V_6$ is nitrogen or a substituted or unsubstituted methine group; $V_7$ is a substituent group, x is an integer of 0 to 4; when x is 2 or more, the groups represented by $V_7$ may be different from each other; and two of $V_7$ may be connected to each other to form a cyclic structure. $V_8$ is —CO—, —$SO_2$—, oxygen or a substituted imino group. $V_9$ is a non-metallic atom group for forming a 5-membered to 8-membered cyclic ring together with the group represented by

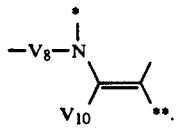

$V_{10}$ is hydrogen or a substituent group.

In the case that the group represented by Time in the formula (1a) pr (1b) is an oxidation-reduction group, Time is preferably represented by the following formula (R-1).

$$*—P—(Y{=}Z)_l—Q—B \qquad \text{(R-1)}$$

In the formula, each of P and Q independently is oxygen or a substituted or unsubstituted imino group; at least one of Y and Z is a methine group having X as a substituent group; each of other Y and Z is a substituted or unsubstituted methine group or nitrogen; l is an integer of 1 to 3 (the groups represented by Y and X may be different from each other); and B is hydrogen or a group capable of being removed by alkali. Any two substituent groups of P, Y, Z, Q and B become divalent groups and may be combined with each other to form a cyclic structure. For example, the groups represented by $(Y{=}Z)_l$ may form benzene ring or pyridine ring.

In the case that each of P and Q is a substituted or unsubstituted imino group, a preferred example is an imino group substituted with a sulfonyl group or an acyl group.

In this case, P and Q are represented as follows.

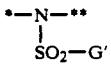

(N-1)

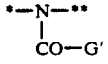

(N-2)

In the formulas, the mark * is a position to connect to hydroquinone mother nucleus in the case of P, and is a position to connect to B in the case of Q. The mark ** is a position to connect to one of free bonding hands of the group represented by —$(Y{=}Z)_l$—.

In the formulas, the group represented by G' is an aliphatic group, an aromatic group or a heterocyclic group.

As the group represented by the formula (R-1), preferred are those represented by the following formula (R-2) or the following formula (R-3).

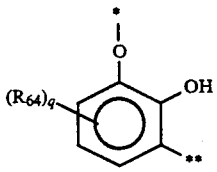

(R-2)

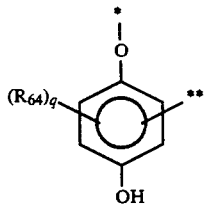

(R-3)

In the formulas, the mark * is a position to connect to hydroquinone mother nucleus, and the mark ** is a position to connect to X.

$R_{64}$ is a substituent group, and q is an integer of 0, or 1 to 3. When q is two or more, the groups represented by $R_{64}$ may be different from each other. Further, when two of $R_{64}$ are substituent groups on the adjacent carbon atoms, they may be divalent groups which are combined with each other to form a cyclic structure.

In the formulas (1a) and (1b), preferred examples of X include mercaptoazoles and benzotriazoles. With respect to mercaptoazoles, mercaptotetrazoles, 5-mercapto-1,3,4-thiazoles and 5-mercapto-1,3,4-oxadiazoles are more preferred. Most preferred is 5-mercapto-1,3,4-thiazole.

Examples of the DIR-hydroquinone represented by the formula (1a) or (1b) are shown below.

(1a-1)

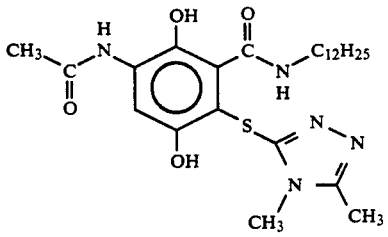

(1a-2)

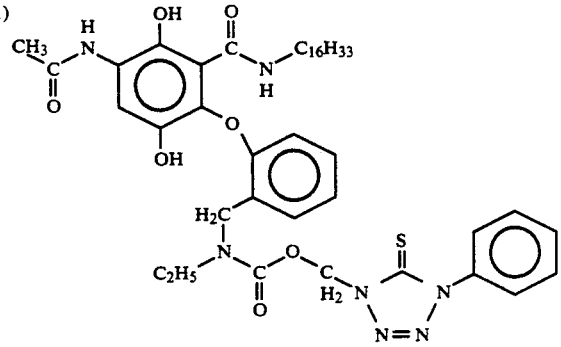

-continued
(1a-3)
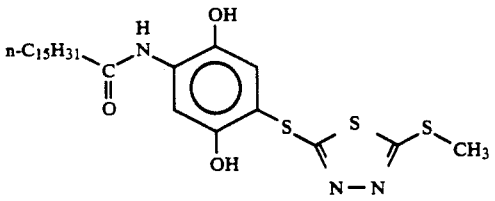
(1a-4)
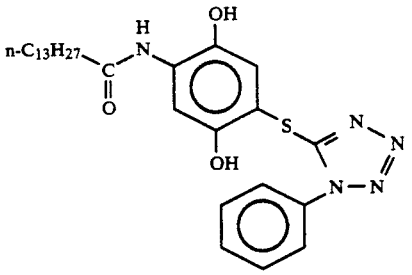
(1a-5)
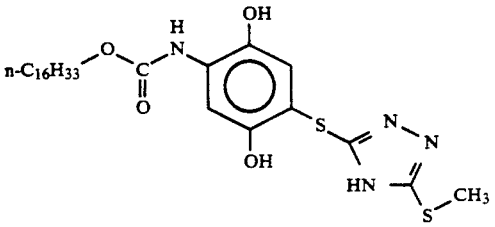
(1a-6)
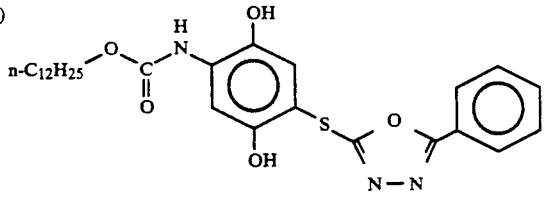
(1a-7)
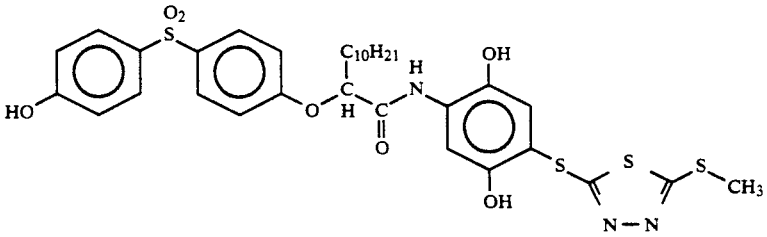
(1a-8)
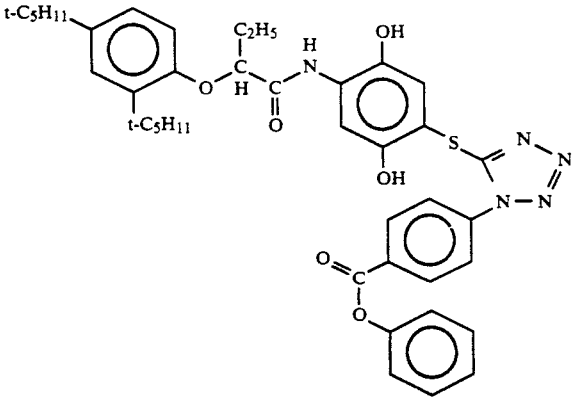
(1a-9)
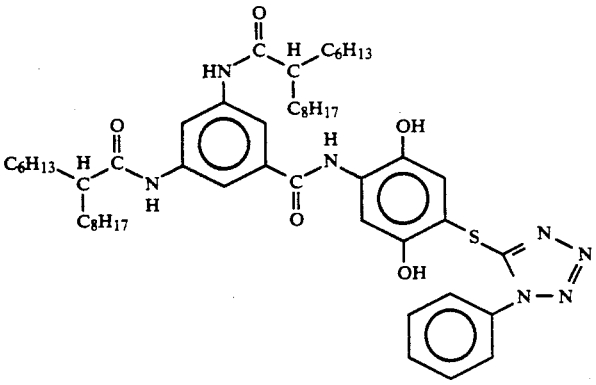

-continued
(1a-10)
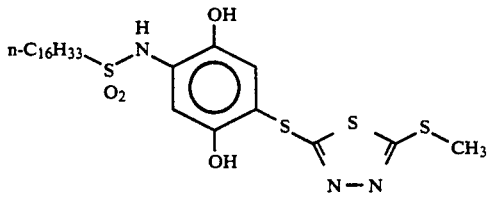
(1a-11)
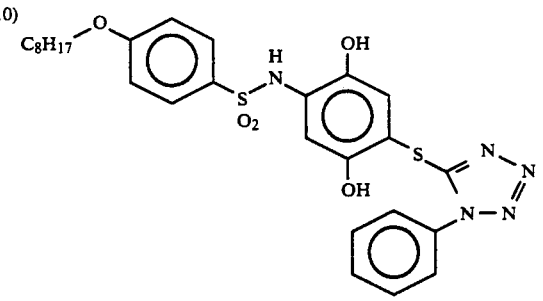
(1a-12)
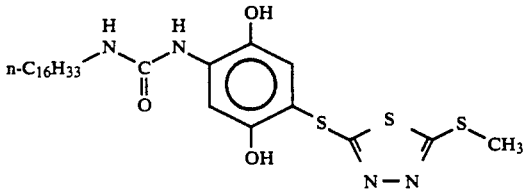
(1a-13)
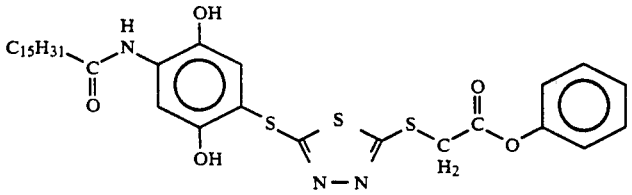
(1a-14)
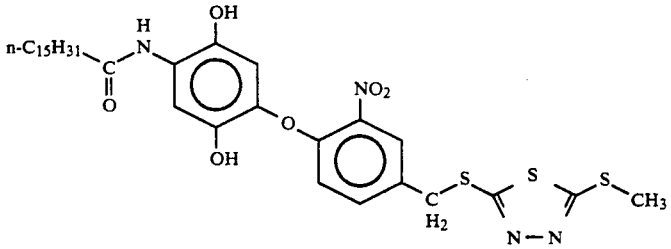
(1a-15)
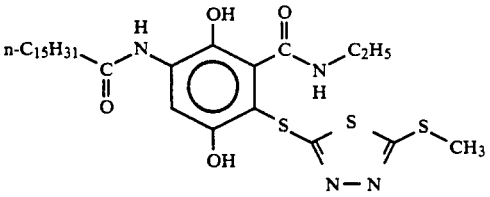
(1a-16)
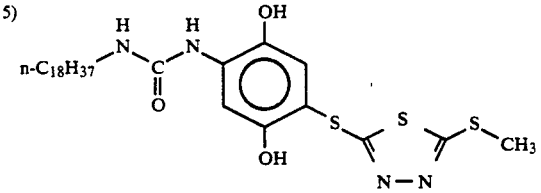
(1a-17)
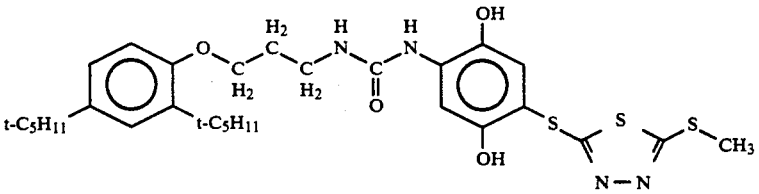
(1a-18)
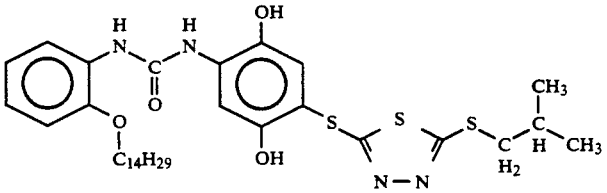

-continued
(1a-19)
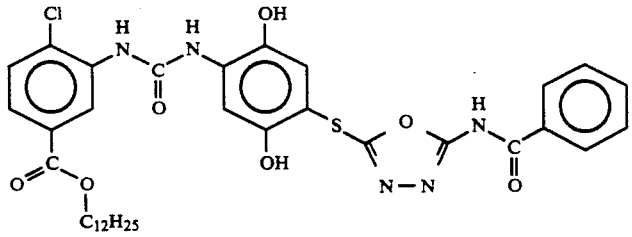
(1a-20)
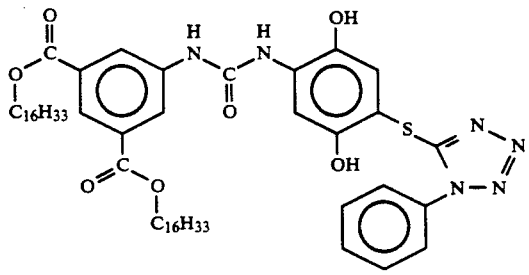
(1a-21)
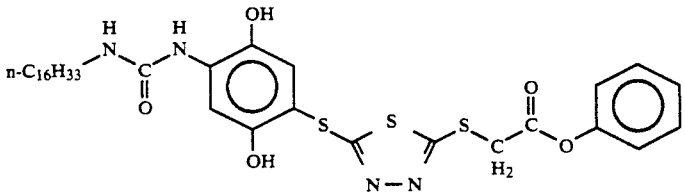
(1a-22)
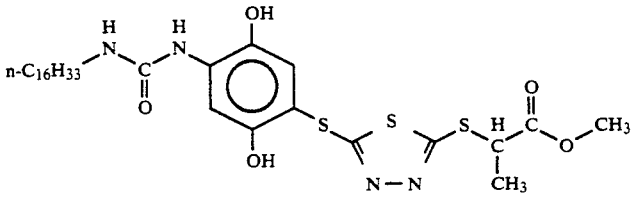
(1a-23)
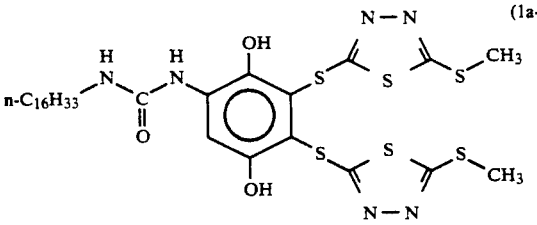
(1a-24)
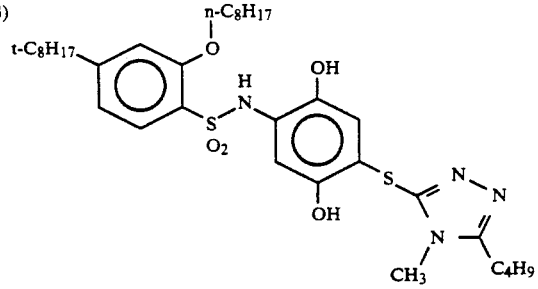
(1a-25)
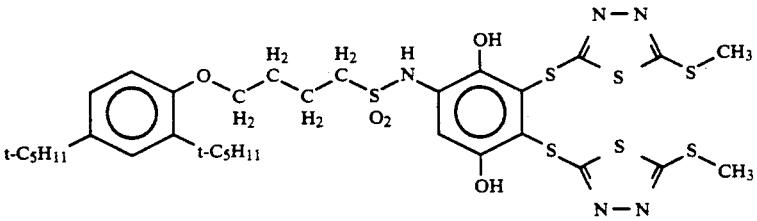
(1a-26)
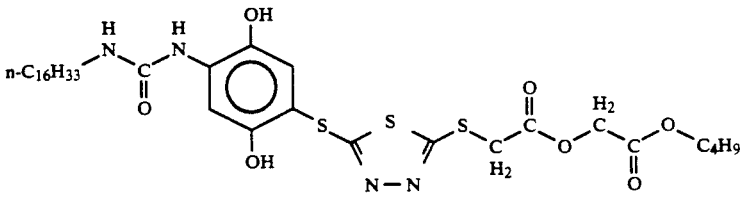

-continued
(1a-27)
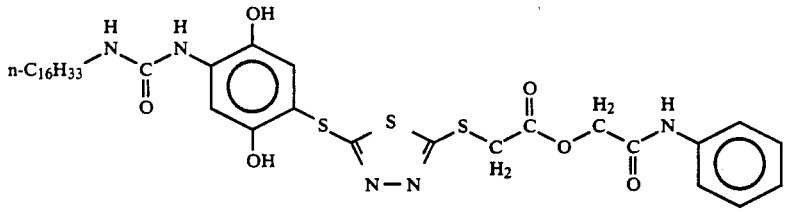
(1a-28)
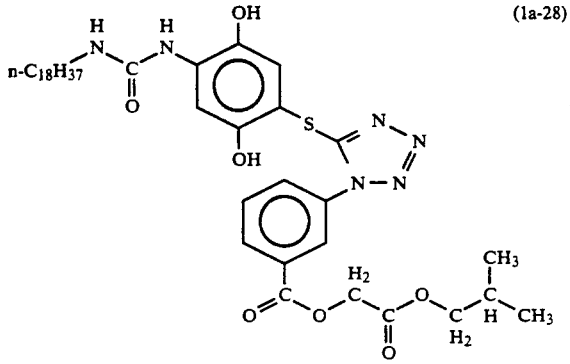
(1a-29)
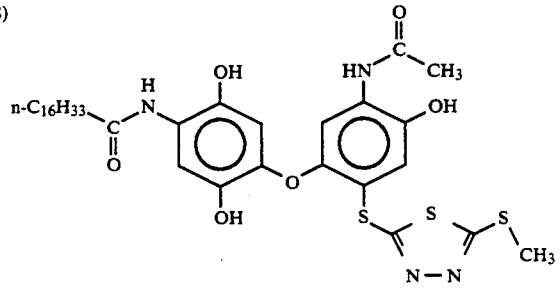
(1a-30)
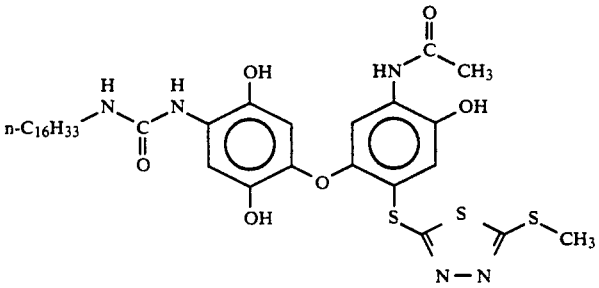
(1a-31)
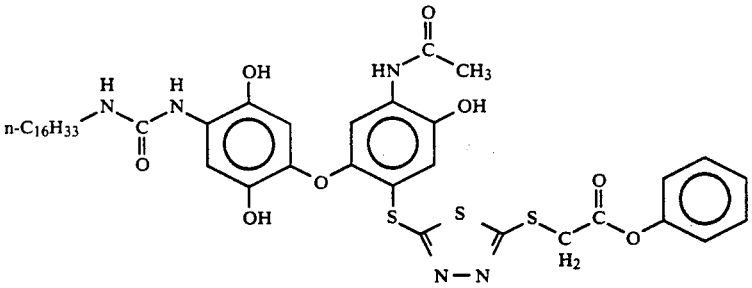
(1a-32)
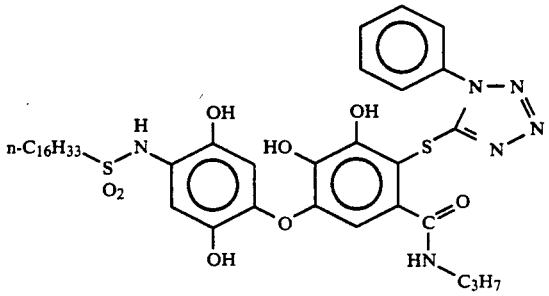

-continued
(1a-33)
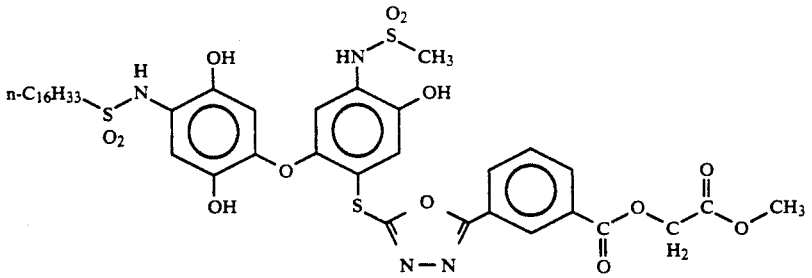
(1a-34)
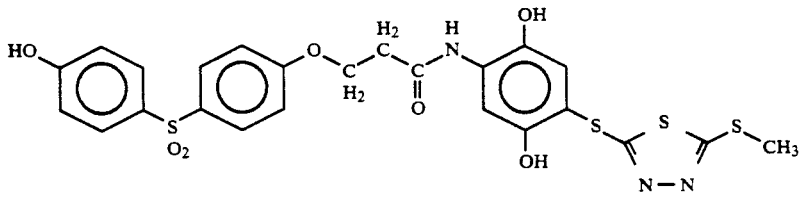
(1a-35)
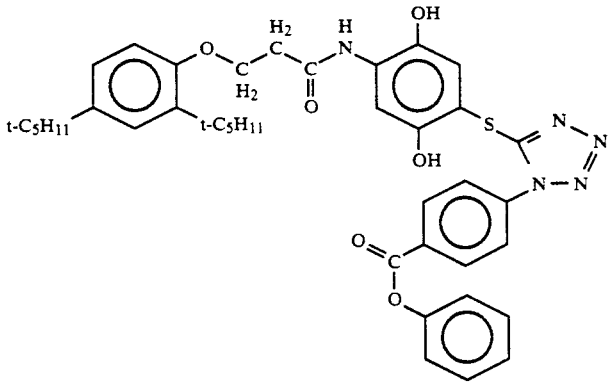
(1b-1)
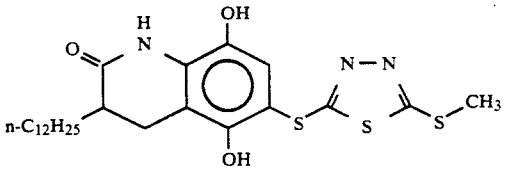
(1b-2)
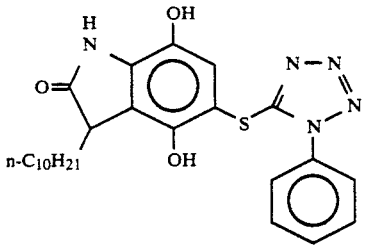
(1b-3)
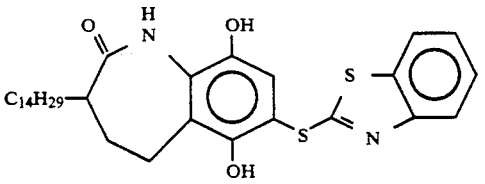
(1b-4)
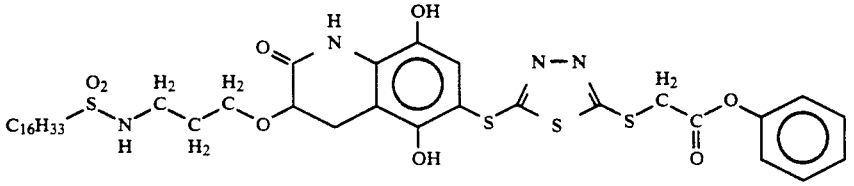

-continued (1b-5)

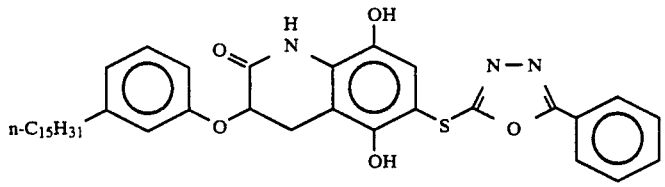

(1b-6)

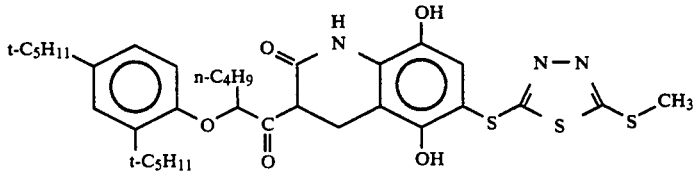

(1b-7)

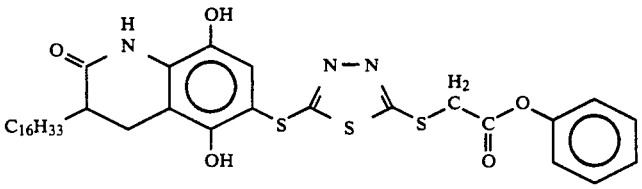

(1b-8)

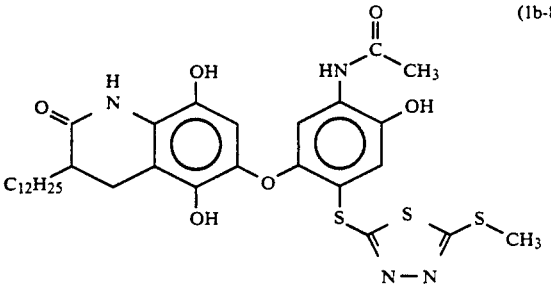

(1b-9)

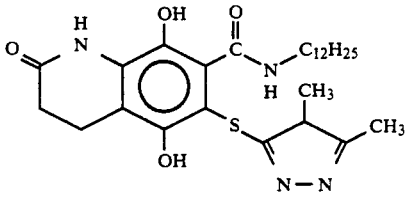

(1b-10)

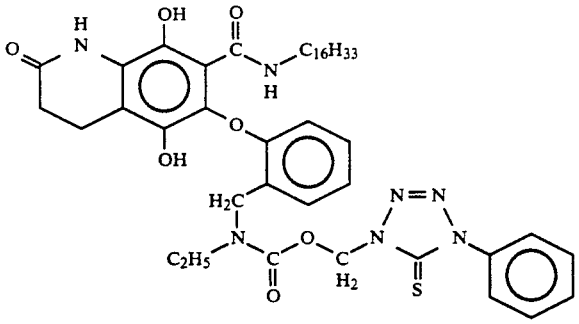

The compound represented by the formula (1a) or (1b) can be synthesized in accordance with methods described in Japanese Patent Provisional Publications No. 49(1974)-129536, No. 52(1977)-57828, No. 60(1985)-21044, No. 60(1985)-233642, No. 60(1985)-233648, No. 61(1986)-18946, No. 61(1986)-156043, No. 61(1986)-213847, No. 61(1986)-230135, No. 61(1986)-236549, No. 62(1987)-62352 and No. 62(1987)-103639; and U.S. Pat. No. 3,379,529, No. 3,620,746, No. 4,332,828, No. 4,377,634 and No. 4,684,604.

The compound represented by the formula (1a) or (1b) is contained in the non-light-sensitive intermediate layer preferably in an amount of $10^{-7}$ mole/m$^2$ to $10^{-3}$ mole/m$^2$, and more preferably in an amount of $10^{-6}$ mole/m$^2$ to $10^{-4}$ mole/m$^2$.

The structure of the photographic material of the present invention, particularly the order of the layers is described below.

In the photographic material of the present invention, a blue sensitive layer, a green sensitive layer, a red sensitive layer and at least one non-light-sensitive layer is provided on a support. There is no specific limitation with respect to the number of the silver halide emulsion layer, the number of the non-light-sensitive layer. There is also no specific limitation with respect to the order of these layers except that the non-light-sensitive layer is an intermediate layer arranged between two of the silver halide emulsion layers. A typical example of the photographic material comprises a support, a red sensitive layer, a green sensitive layer and a blue sensitive layer in this order. However, the other orders are also available. Each of the red, green and blue sensitive layers may comprises two or more silver halide emulsion layers. The emulsion layers are different from each other with respect to the strength of the sensitivity, and the spectral sensitivities of the emulsion layers is the same with respect to blue, green or red.

FIG. 1*a* is a sectional view schematically illustrating an embodiment of the photographic material of the present invention. In this embodiment, the photographic material comprises a support (11), a red sensitive layer (12), a non-light-sensitive intermediate layer containing the DIR-hydroquinone (13), a green sensitive layer (14) and a blue sensitive layer (15) in the order. As is shown in FIG. 1*a*, the non-light-sensitive intermediate layer is preferably arranged between the green sensitive layer and the red sensitive layer.

Other non-light-sensitive intermediate layers which do not contain the DIR-hydroquinone can be provided between the silver halide emulsion layers. Further, an undercoating layer or an overcoating layer can also be provided on the photographic material.

The intermediate layer containing the DIR-hydroquinone, namely the compound represented by the formula (1a) or (1b) and other intermediate layers may further contain a coupler and another DIR compound. Examples of the coupler and DIR compound are described in Japanese Patent Provisional Publications No. 61(1986)-43748, No. 59(1974)-113438, No. 59(1974)-113440, No. 61(1986)-20037 and No. 61(1986)-20038. The intermediate layers may further contain a color stain inhibitor which is conventionally used.

Each of the red, green and blue sensitive layers may comprises two silver halide emulsion layers, namely a high sensitive silver halide emulsion layer and a low sensitive silver halide emulsion layer, as is described in West German Patent No. 1,121,470 and U.K. patent No. 923,045. In the present invention, the photographic material preferably satisfies the following conditions (1) to (4).

(1) The blue, green or red sensitive layer arranged nearest under the non-light-sensitive intermediate layer (between the support and the non-light-sensitive intermediate layer) comprises two or more silver halide emulsion layers.

(2) The emulsion layers are different from each other with respect to the strength of the sensitivity.

(3) The spectral sensitivities of the emulsion layers is the same with respect to blue, green or red.

(4) The lowest sensitive emulsion layer is arranged between the highest sensitive emulsion layer and the non-light-sensitive intermediate layer.

In other words, with respect to the two layers interposing the non-light-sensitive intermediate layer containing the compound represented by the formula (1a) or (1b), the layer which is relatively closer to the support comprises two or more silver halide emulsion layers, and the low sensitive emulsion layer is placed between the high sensitive emulsion layer and the non-light-sensitive intermediate layer.

Figure 1B:
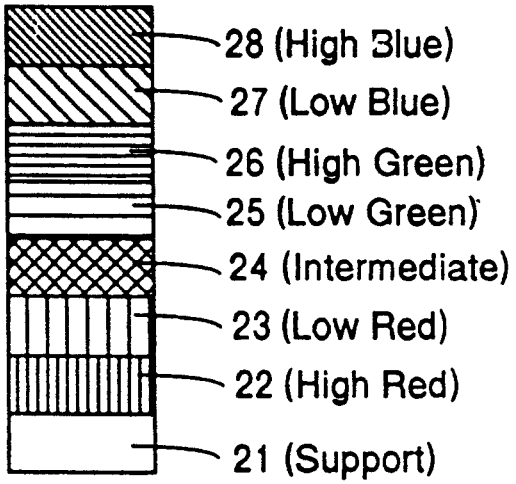

FIG. 1*b* is a sectional view schematically illustrating an embodiment of the photographic material which satisfies the conditions (1) to (4). In this embodiment, the photographic material comprises a support (21), a high red sensitive layer (22), a low red sensitive layer (23), a non-light-sensitive intermediate layer containing DIR-hydroquinone (24), a low green sensitive layer (25), a high green sensitive layer (26), a low blue sensitive layer (27) and a high blue sensitive layer (28) in the order.

Figure 1C:
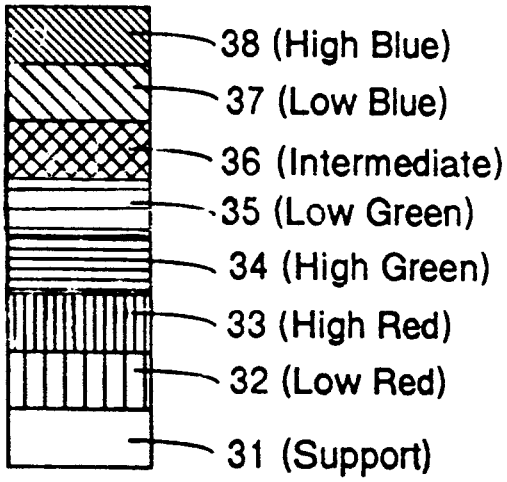

FIG. 1*c* is a sectional view schematically illustrating another embodiment of the photographic material which satisfies the conditions (1) to (4). In this embodiment, the photographic material comprises a support (31), a low red sensitive layer (32), a high red sensitive layer, (33), a high green sensitive layer (34), a low green sensitive layer (35), a non-light-sensitive intermediate layer containing the DIR-hydroquinone (36), a low blue sensitive layer (37) and a high blue sensitive layer (38) in the order.

Further, The blue, green or red sensitive layer may comprise three or more silver halide emulsion layers, as described in Japanese Patent Publication No. 49(1974)-15495. Even in this case, the emulsion layer closer to the support than the non-light-sensitive intermediate layer containing the compound of the formula (1a) or (1b) is arranged in the order of a low sensitive emulsion layer, a middle sensitive emulsion layer and a high sensitive emulsion layer, or in the order of a low sensitive emulsion layer, a high sensitive emulsion layer and a middle sensitive emulsion layer.

Figure 1D:
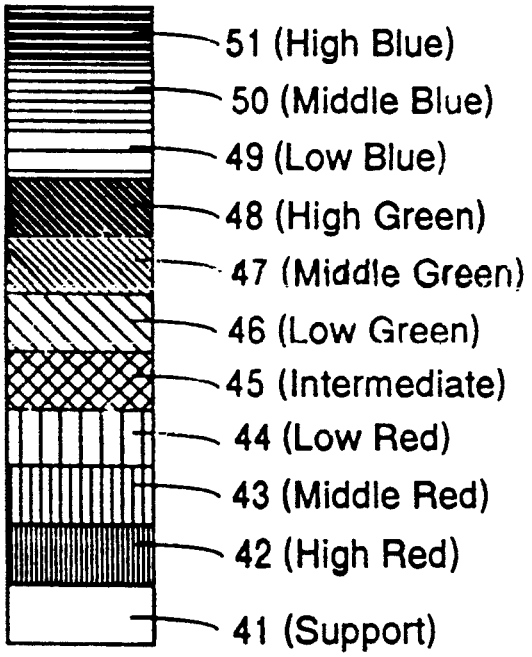
Figure 2:
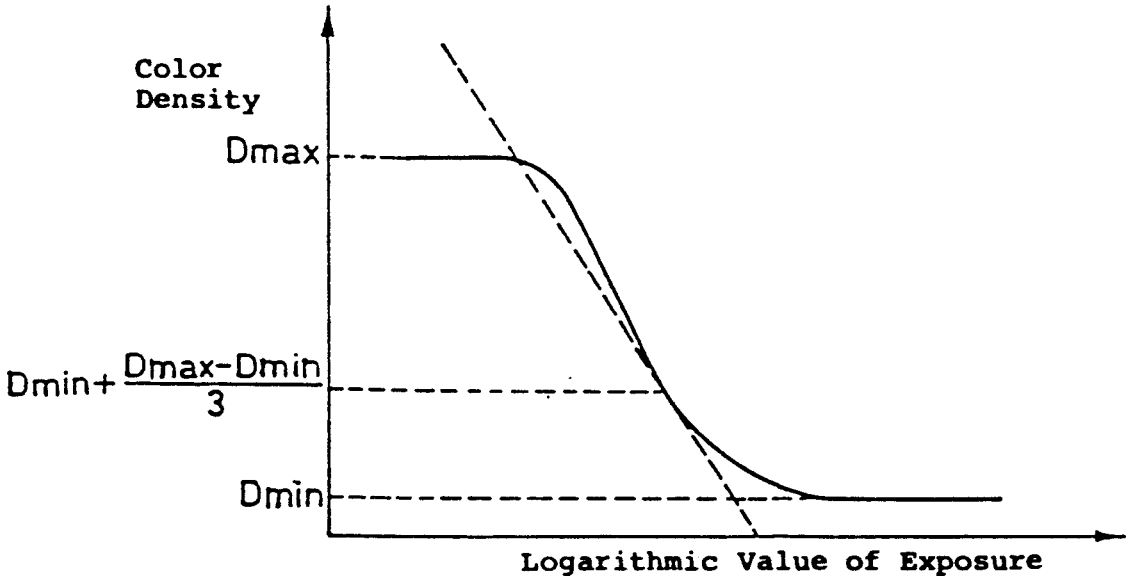
FIG. 2 is a graph showing a method of determining gamma from a characteristic curb of a photographic material.

FIG. 1*d* is a sectional view schematically illustrating an embodiment of the photographic material using three or more silver halide emulsion layers. In this embodiment, the photographic material comprises a support (41), a high red sensitive layer (42), a middle red sensitive layer (43), a low red sensitive layer (44), a non-light-sensitive intermediate layer containing the DIR-hydroquinone (45), a low green sensitive layer (46), a middle green sensitive layer (47), a high green sensitive layer (48), a low blue sensitive layer (49), a middle blue sensitive layer (50) and a high blue sensitive layer (51) in the order.

To more improve the color reproducibility, a donor layer (CL) showing multi-layer effect which has different spectral sensitivity distribution from the main layers (BL, GL and RL) is preferably arranged adjacently or close to the main light-sensitive layers, as is described in U.S. Pat. No. 4,663,271, No. 4,705,744 and No. 4,707,436, and Japanese Patent Provision Publications No. 62(1987)-160448 and No. 63(1983)-89580.

In the present invention, it is also preferred that the thickness of the non-light-sensitive intermediate layer containing the compound of the formula (1a) or (1b) is less than 0.8 μm, and the blue, green or red sensitive layer or the non-light-sensitive intermediate layer further contains a compound represented by the formula (2).

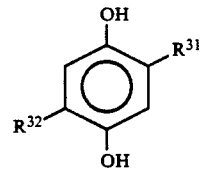

(2)

In the formula (2), $R^{31}$ and $R^{32}$ independently is a substituent group of the hydroquinone nucleus.

Examples of the substituent groups represented by $R^{31}$ or $R^{32}$ include an alkyl group, an aryl group, an alkylthio group, an arylthio group, an alkoxy group, an aryloxy group, an amido group, a sulfonamido group, an alkoxycarbonylamino group, an ureido group, a sulfonyl group, a sulfoalkyl group, carboxyl, a carboxyalkyl group and an alkylsulfonyl group.

The substituent groups represented by $R^{31}$ and $R^{32}$ preferably contain at least one carbon atom. The number of the total carbon atoms contained in the groups is preferably 6 to 36, and more preferably 8 to 24.
Examples of the compound represented by the formula (2) are shown below.
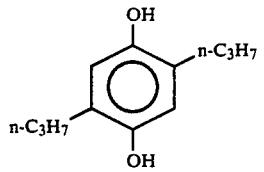
(2-1)
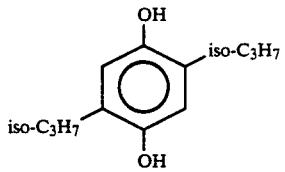
(2-2)
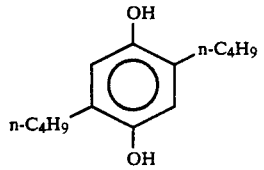
(2-3)
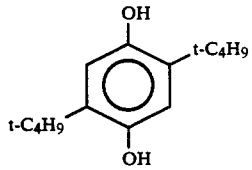
(2-4)
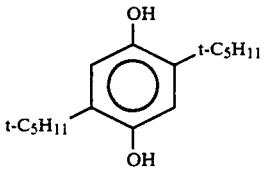
(2-5)
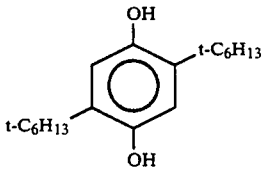
(2-6)
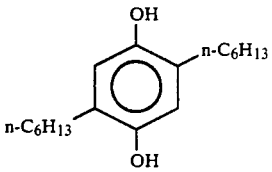
(2-7)
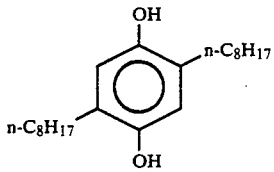
(2-8)
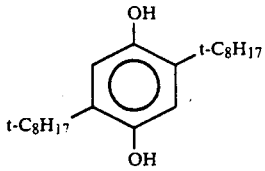
(2-9)
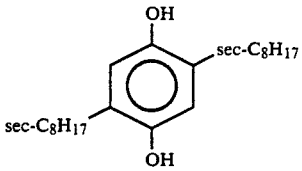
(2-10)
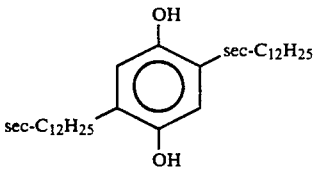
(2-11)
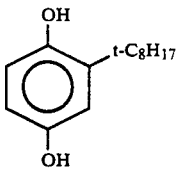
(2-12)
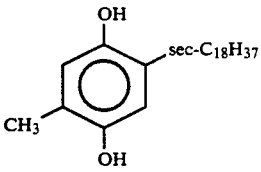
(2-13)
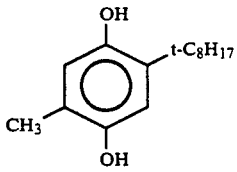
(2-14)
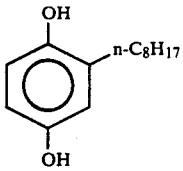
(2-15)
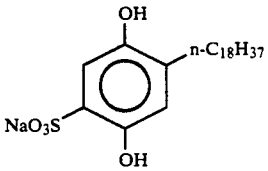
(2-16)

-continued (2-17)

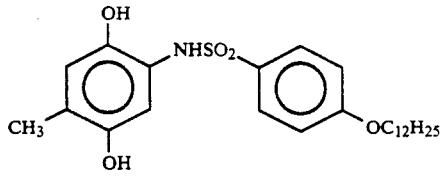

(2-18)

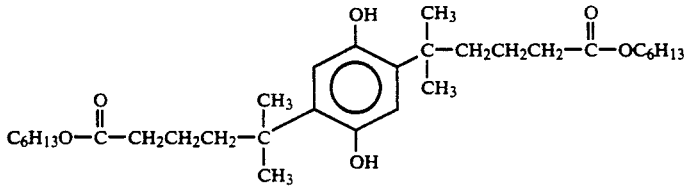

(2-19)

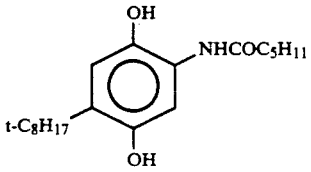

(2-20)

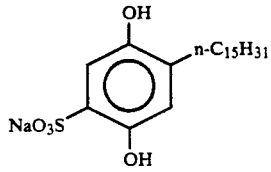

(2-21)

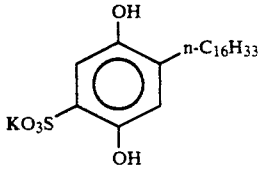

(2-22)

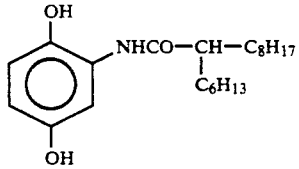

(2-23)

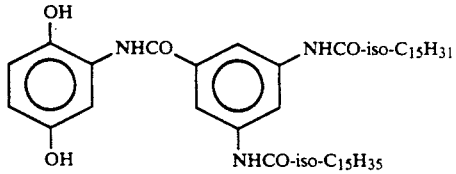

(2-24)

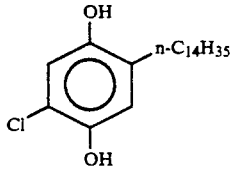

The amount of the compound represented by the formula (2) is preferably in the range of 0.02 to 4 mmole/m$^2$, and more preferably in the range of 0.05 to 0.4 mmole/m$^2$. Two or more kinds of the compounds represented by the formula (2) may be used for the same layer, or different compounds of the formula (2) may be used for each layers.

The compound of the formula (2) are preferably contained in the non-light-sensitive intermediate layer containing the compound of the formula (1a) or (1b). Particularly, the intermediate layer containing both of the compounds is preferably arranged between the green sensitive layer and the red sensitive layer.

The thickness of the non-light-sensitive layer containing the compound of the formula (1a) or (1b) and the compound of the formula (2) preferably is less than 0.8 μm. The thickness more preferably is less than 0.6 μm.

Next, the silver halide emulsion layer is described below.

In the photographic material of the invention, preferred silver halide contained in the emulsion layer is silver iodobromide, silver iodochloride or silver chloroiodobromide containing silver iodide in an amount of not more than about 30% by mole. Particularly preferred is silver iodobromide or silver chloroiodobromide, containing silver iodide in an amount of about 0.1 to 50% by mole.

The shape of the silver halide grain in the photographic emulsion may be either in the form of a regular crystal such as cube, octahedron and tetradecahedron, or in the form of an irregular crystal such as globular shape and plate shape, or in the form of a crystal having crystal defect such as twinning plane. Further, the shape of the grain may be complex of these crystals.

The silver halide grains may be either fine grains whose size is not more than about 0.2 μm or large grains whose projected area is about 10 μm in diameter. The emulsion containing the silver halide grains may be either a polydispersed emulsion or a mono-dispersed emulsion.

A photographic emulsion of silver halide available for the invention can be prepared in accordance with a known method described in, for example, "Emulsion Preparation and Types", *Research Disclosure*, No. 17643 (December, 1978), pp. 22–23; or ibid., No. 18716 (November, 1979), pp. 648; "Chimie et Physique Photographique" by P. Glafkides, Paul Montel, 1967; "Photographic Emulsion Chemistry" by G. F. Duffin, Focal Press, 1966; or "Making and Coating Photographic Emulsion" by V. L. Zelikman et al., Focal Press, 1964.

A monodispersed emulsion described in U.S. Pat. No. 3,574,628 and No. 3,655,394, U.K. Patent 1,413,748 is also preferable.

A tabular silver halide grain having an aspect ratio of not less than 5 can be also employed in the invention. A tabular silver halide grain can be easily prepared in accordance with methods described in "Photographic Science and Engineering" by Gutoff, vol. 14(1970), pp. 248–257; U.S. Pat. No. 4,434,226, No. 4,414,310, No.

4,433,048 and No. 4,439,520; and U.K. Patent No. 2,112,157.

The crystal may have either a homogeneous structure, a heterogeneous structure in which halogens located at the inside and the outside are different from each other, or a structure consisting of layers. Some silver halides in which halogens are different from each other may connect by epitaxial bond to form the crystal, or a salt other than silver halide such as silver rhodanite and lead oxide also may connect to the silver halide crystal by epitaxial bond.

A mixture of grains of various crystals is also available.

Generally, a silver halide emulsion having been subjected to physical ripening, chemical ripening and spectral sensitization is used in the invention. Additives used in these processes are described in *Research Disclosure* No. 17643 and ibid., No. 18716. The pages in which the additives are described are set forth in the following table.

Known photographic additives available for the invention are also described in the above two Research Disclosures. The pages are also set forth in the following table.

TABLE

| Additives | R.D. No. 17643 | R.D. No. 18716 |
|---|---|---|
| 1. Chemical Sensitizer | p. 23 | p. 648, Right |
| 2. Sensitivity Promoter | | same as above |
| 3. Spectral Sensitizer Color Sensitizer | pp. 23-24 | pp. 648, Right-649, Left |
| 4. Whitening Agent | p. 24 | |
| 5. Antifoggant and Stabilizer | pp. 24-25 | p. 649, Right |
| 6. Light Absorber, Filter Dye, U.V. Absorber | pp. 25-26 | pp. 649, Right-650, Left |
| 7. Antistain Agent | p. 25, Right | p. 650, Left-Right |
| 8. Dye Image Stabilizer | p. 25 | |
| 9. Hardening Agent | p. 26 | p. 651, Left |
| 10. Binder | p. 26 | same as above |
| 11. Plasticizer, Lubricant | p. 27 | p. 650, Right |
| 12. Coating Aid, Surface Active Agent | pp. 26-27 | p. 650, Right |
| 13. Antistatic Agent | p. 27 | same as above |

In order to prevent deterioration of photographic properties caused by formaldehyde gas, compounds which react with formaldehyde to fix it, described in U.S. Pat. No. 4,411,987 and No. 4,435,503, are preferably added to the photographic material.

Various color couplers can be used for the invention. Concrete examples of the couplers are described in the patents cited in the aforementioned *Research Disclosure* No. 17643, VII C-G. As yellow couplers, preferred are those described in, for example, U.S. Pat. No. 3,933,501, No. 4,022,620, No. 4,326,024, No. 4,401,752 and No. 4,248,961, Japanese Patent Publication No. 58(1983)-10739, U.K. Patents No. 1,425,020 and No. 1,476,760, U.S. Pat. No. 3,973,968, No. 4,314,023 and No. 4,511,649, and European Patent No. 249,473A.

As magenta couplers, 5-pyrazolone type and pyrazoloazole type compounds are preferred, and particularly preferred are those described in U.S. Pat. No. 4,310, 619 and No. 4,351,897, European Patent No. 73,636, U.S. Pat. No. 3,061,432 and No. 3,725,067, *Research Disclosure* No. 24220 (June, 1984), Japanese Patent Provisional Publication No. 60(1985)-33552, *Research Disclosure No.* 24230 (June, 1984), Japanese Patent Provisional Publications No. 60(1985)-43659, No. 61(1986)-72233, No. 60(1985)-35730, No. 55(1980)-118034 and No. 60(1985)-185951, U.S. Pat. No. 4,500,630, No. 4,540,654 and No. 4,556,630, and International Publication No. WO88/04795.

As cyan couplers, there can be mentioned phenol type and naphthol type couplers, and preferred examples are those described in U.S. Pat. No. 4,052,212, No. 4,146,396, No. 4,228,233, No. 4,296,200, No. 2,369,929, No. 2,801,171, No. 2,772,162, No. 2,895,826, No. 3,772,002, No. 3,758,308, No. 4,334,011 and No. 4,327,173, West German Patent Publication No. 3,329,729, European Patents No. 121,365A and No. 249,453A, U.S. Pat. No. 3,446,622, No. 4,333,999, No. 4,775,616, No. 4,451,559, No. 4,427,767, No. 4,690,889, No. 4,254,212 and No. 4,296,199, and Japanese Patent Provisional Publication No. 61(1986)-42658.

Colored couplers to compensate incidental absorption of a formed dye are preferably those described in *Research Disclosure* No. 17643, VII-G, U.S. Pat. No. 4,163,670, Japanese Patent Publication No. 57(1982)-39413, U.S. Pat. No. 4,004,929 and No. 4,138,258, and U.K. Patent No. 1,146,368. It is also preferred to use a coupler whose fluorescent dye released in coupling stage compensates incidental absorption of a formed dye as described in U.S. Pat. No. 4,774,181, and a coupler having as an eliminating group a dye precursor which reacts with a developing agent to form a dye as described in U.S. Pat. No. 4,777,120.

As a coupler which gives a color developing dye exhibiting a proper diffusion, preferred are those described in U.S. Pat. No. 4,366,237. U.K. Patent No. 2,125,570, European Patent No. 96,570, and West German Patent Publication No. 3,234,533.

Typical examples of polymerized dye-forming couplers are described in U.S. Pat. No. 3,451,820, No. 4,080,211, No. 4,367,282, No. 4,409,320 and No. 4,576,910, and U.K. Patent No. 2,102,173.

A coupler which releases a photographically useful residue in accordance with coupling can be also used in the invention. DIR couplers which release a development inhibitor are preferably those described in the patents cited in the aforementioned *Research Disclosure* No. 17643, VII-F, Japanese Patent Provisional Publications No. 57(1982)-151944, No. 57(1982)-154234, No. 60(1985)-184248 and No. 63(1988)-37346, and U.S. Pat. No. 4,248,962 and No. 4,782,012.

Couplers which imagewise release a nucleating agent or a development accelerator in the developing process are preferably those described in U.K. Patents No. 2,097,140 and No. 2,131,188, and Japanese Patent Provisional Publications No. 59(1984)-157638 and No. 59(1984)-170840.

Examples of other couplers available for the photosensitive material of the invention include a competing coupler described in U.S. Pat. No. 4,130,427; a polyvalent coupler described in U.S. Pat. No. 4,283,472, No. 4,338,393 and No. 4,310,618; a DIR redox compound-releasing coupler, a DIR coupler-releasing coupler, a DIR coupler-releasing redox compound or a DIR redox-releasing redox compound described in Japanese Patent Provisional Publications No. 60(1985)-185950 and No. 62(1987)-24252; a coupler which releases a dye having restoration to original color after elimination described in European Patent No. 173,302A; a bleach accelerator-releasing coupler described in *Research Disclosure* No. 11449, ibid. No. 24241, and Japanese Patent Provisional Publication No. 61(1986)-201247; a coupler which releases ligand described in U.S. Pat. No.

4,553,477; a coupler which releases a leuco dye described in Japanese Patent Provisional Publication No. 63(1988)-75747; and a coupler which releases a fluorescent dye described in U.S. Pat. No. 4,774,181.

The couplers used in the invention can be introduced into the photographic material by various known dispersing methods.

Examples of high-boiling solvents employable in an O/W dispersing method are described in U.S. Pat. No. 2,322,027.

Concrete examples of the high-boiling organic solvents having a boiling point of not lower than 175° C. under a normal pressure employable in the O/W dispersing method include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate); esters of phosphoric acids or phosphonic acids (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate); benzoic esters (e.g., 2-ethylhexyl benzoate, dodecyl benzoate, 2-ethylehecyl-p-hydroxybenzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic carboxylic esters (e.g., bis(2-ethylhexyl)sebacate, dioctyl azelate, glycerol tributylate, isostearyl lactate, trioctyl citrate); aniline derivatives (e.g., N,N-dibutyl-2-butoxyl-5-tert-octylaniline); and hydrocarbons (e.g., paraffin, dodecyl benzene, diisopropyl naphthalene). As an assisting solvent, there can be used organic solvents having a boiling point of not lower than about 30° C., preferably in the range of 50° C. to about 160° C., and typical examples thereof include ethyl acetate, butyl acetate, ethyl propionate, methyl ethyl ketone, cyclohexanone, 2-ethoxyethyl acetate and dimethylformamide.

A high-boiling organic solvent having a dielectric constant of not less than 6.0 is particlarly preferred. Examples of the solvent are represented by the following formulas.

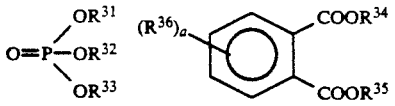

In the formulas, each of $R^{31}$, $R^{32}$, $R^{33}$, $R^{34}$ and $R^{35}$ independently is an alkyl group or a cycloalkyl group. $R^{36}$ is a halogen atom (F, Cl, Br or I), an alkyl group, an alkoxy group, an aryloxy group or an alkoxycarbonyl group. In the formulas, "a" is an integer of 0 or 1 to 3. When "a" is 2 or 3, the groups represented by $R^{36}$ may be different from each other.

A process of a latex dispersing method, effects thereof and concrete examples of latex for impregnation are described in U.S. Pat. No. 4,199,363, West German Patent Applications (OLS) No. 2,541,274 and No. 2,541,230.

Further, these couplers can be emulsified and dispersed in an aqueous solution of hydrophilic colloid by impregnating a rhodable latex polymer (e.g., U.S. Pat. No. 4,203,716) with these couplers in the presence or absence of the aforementioned high-boiling organic solvent or by dissolving these couplers in a water-insoluble and organic solvent-soluble polymer.

Preferably, homopolymers and copolymers described in International Publication No. W088/00723, pp. 12–30, are employed. Particularly, it is preferred to use acrylamide type polymers from the viewpoint of stabilization of a color image.

The color photographic material of the invention preferably contains various antiseptic or antimold agents such as benzoisothiazolone, n-butyl-p-hydroxybenzoate, phenol and 2-(4-thiazolyl)benzimidazole described in Japanese Patent Provisional Publications No. 63(1988)-257747 and No. 62(1987)-272248, and Japanese Patent Application No. 62(1987)-238096.

The photographic material of the invention may contain a dye represented by the following formula.

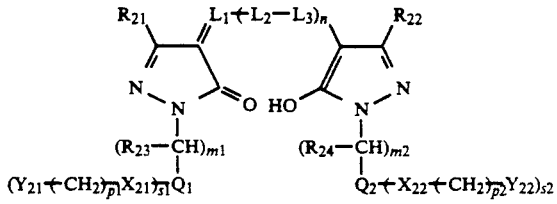

In the formula, each of $R_{21}$ and $R_{22}$ independently is $-COOR_{25}$ or $-COOR_{25}R_{26}$. Each of $R_{25}$ and $R_{26}$ independently is hydrogen, an alkyl group or an aryl group. $R_{25}$ and $R_{26}$ may form a 5-membered or 6-membered ring. Each of $Q_1$ and $Q_2$ independently is an aryl group. Each of $X_{21}$ or $X_{22}$ independently is a single bond or a divalent linking group. Each of $Y_{21}$ and $Y_{22}$ independently is sulfo or carboxyl. Each of $L_1$, $L_2$ and $L_3$ independently is a methyne group. In the formula, each of m1 and m2 independently is 1 or 2, n is 0, 1 or 2, each of p1 and p2 independently is 0, 1, 2, 3 or 4, and each of s1 and s2 independently is 1 or 2.

The photographic material of the invention may further contains a water-insoluble epoxy compound represented by the following formula.

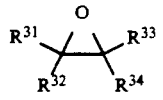

In the formula, each of $R^{31}$, $R^{32}$, $R^{33}$ and $R^{34}$ independently is hydrogen, an aliphatic group, an aromatic group, an aliphaticoxycarbonyl group, an aromatic oxycarbonyl group or a carbamoyl group. At least one of $R^{31}$, $R^{32}$, $R^{33}$ and $R^{34}$ is not hydrogen. The number of the total carbon atoms contained in $R^{31}$, $R^{32}$, $R^{33}$ and $R^{34}$ is 8 to 60. $R^{31}$ and $R^{32}$ may form a 5 to 7-membered ring. $R^{33}$ and $R^{34}$ also may form a 5 to 7-membered ring.

The present invention can be applied to various color photographic materials. Representative examples thereof include color negative films for domestic use or motion pictures, color reversal films for slide and television, color paper, color positive films, and color reversal paper.

Appropriate supports employable in the invention are described in, for example, the aforementioned *Research Disclosure* No. 17643, p. 28, and ibid., No. 18716, pp. 647 (right)–648 (left).

In the photographic material of the invention, the total film thickness of all of the hydrophilic colloidal layers on the side having the emulsion layer is preferably not more than 28 μm, more preferably not more than 23 μm, most preferably not more than 20 μm. Further, the film swelling speed $T\frac{1}{2}$ is preferably not more than 30 sec. The terms "film thickness" means a film thickness measured at 25° C. and a relative humidity of 55% under moisture conditioning (2 days), and the film swelling speed $T\frac{1}{2}$ can be measured according to a manner known in the technical art. The film swelling speed can be measured using, for example, a swellometer described in Photographic Science and Engineering, vol. 19, No. 2, pp. 124–129, by A. Green et al. $T\frac{1}{2}$ is defined as a time required to reach a saturated film thickness of a film, in the case where the saturated film thickness is 90% of a maximum swelling film thickness given when the film is treated with a color developer at 30° C. for 3 minutes and 15 seconds.

The film swelling speed $T\frac{1}{2}$ can be adjusted by adding a hardening agent to gelatin used as a binder or varying conditions on the elapsed time after a coating process. Further, the swelling degree is preferably between 150 and 400%. The swelling degree can be calculated using the maximum swelling film thickness under the conditions described above in accordance with the formula: (Maximum swelling film thickness—film thickness)-/film thickness.

The color photographic material according to the invention can be developed by conventional processes described in the aforementioned *Research Disclosure* No. 17643, pp. 28–29, and ibid., No. 18716, p. 615 (left to right).

The present invention shows marked effects when it is treated with a developer containing a solvent for silver halide, for example, sulfurous acid soda, potassium thiocyanate and thioethers. A concrete example of the developers is a first developer used in the reversal processing.

The amount of the solvent for the silver halide is preferably not less than 0.1 g, more preferably not less than 0.5 g, per 1 l of the developer. The upper limit of the amount thereof is a saturated dissolving amount. The solvent is preferably employed in combination of two or more kinds.

The effect of the present invention is markedly shown when rapidity is required for the process of treating the invention, and it is desired that the process is carried out under such conditions that the temperature is high (not lower than 33° C.), the processing time is short and the time for the first developing is not longer than 6 minutes. Particularly, the effect of the invention is markedly shown when the first developing is carried out at a temperature of not lower than 38° C. and for a period of time of not longer than 90 seconds, preferably not longer than 60 seconds.

The color reversal film treating process generally comprises the basic steps of:

Black and white development (first development)→stopping→washing→reversing→washing→color development→stopping→washing→compensating bath→washing→bleaching→washing→fixing→washing→stabilizing→drying.

To this process may be further added prebath, prehardening bath or nuetralizing bath. Otherwise, each washing process conducted after stopping, reversing, color developing, compensating bath or bleaching may be omitted. The reversing bath may be replaced with re-exposure, or may be omitted if a fogging agent is added to the color developing bath.

As black and white developers, any known developing agents such as dihydroxybenzenes (e.g., hydroquinone), 3-pyrazolidones (e.g., 1-phenyl-3-pyrazolidone), aminophenols (e.g., N-methyl-p-aminophenol) can be employed singly or in combination.

The black and white developing solution may contain development inhibitors such as carbonate, borate, phosphate, sulfite, bromide and iodide, or antifogging agents such as organic antifogging agent, in addition to the aforementioned solvent for silver halide. If necessary, the developer may further contain softening agents, preservatives (e.g., hydroxylamine), organic solvents (e.g., benzyl alcohol and diethylene glycol), development accelerators (e.g, polyethylene glycol, quaternary ammonium salt and amines), dye forming couplers, competing couplers, fogging agents (e.g., sodium boronhydride), developing aids (e.g., 1-phenyl-3-pyrazolidone), viscosity-imparting agents, polycarboxylic acid type chelating agents described in U.S. Pat. No. 4,083,723, and antioxidants described in West German Patent Publication (OLS) No. 2,622,950.

The pH value of the black and white developing solution is preferably adjusted to 8.5 to 11.5. The black and white development is carried out preferably for not more than 75 seconds, and more preferably for not more than 60 seconds.

A color developer is generally made of an alkaline aqueous solution containing a color developing agent. As the color developing agent, there can be employed any known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamideethylaniline, 4-amino-3-methyl-N-ethyl-N-β-methoxyethylanilie).

Other than the above-mentioned developing agents, also employable are those described in F. A. Mason, "Photographic Processing Chemistry", Focal Press, pp. 226–229 (1966), U.S. Pat. No. 2,193,015 and No. 2,592,364, and Japanese patent Provisional Publication No. 48(1973)-64933.

Further, the color developer can also contain additives described with respect to the black and white developer.

The bleaching process may be conducted simultaneously with the fixing process. Otherwise, those processes may be conducted separately. Examples of the bleaching agents employable in the bleaching process include polyvalent metal compounds such as iron(III), cobalt(III), chromium(VI) and copper(II), peroxides, quinones and nitroso compounds. Concretely, there can be employed organic complex salts of ferricyanides, dichromates, iron(III) or cobalt(III), for example, complex salts of organic acids such as aminopolycarboxylic acid (e.g., ethylenediaminetetraacetaic acid, nitrilotriacetic acid, 1,3-diamino-2-propanoltetraacetic acid), citric acid, tartaric acid and malic acid; persulfates; permanganates; and nitroso phenols. Of these, particularly useful are potassium ferricyanide, ethylenediaminetetraacetic acid sodium iron(III) salt and and ethyolenediaminetetraacetic acid ammonium iron (III) salt. Ethylenediaminetetraacetic acid iron (III) salt is useful both in the individual bleaching bath and the combined bleach-fix bath.

To the bleaching bath or the bleach-fix bath may be also added bleaching accelerators described in U.S. Pat. No. 3,042,520 and No. 3,241,966, and Japanese Patent Publications No. 45(1970)-8506 and No. 45(1970)-8836, thiol compounds described in Japanese Patent Provisional Publication No. 53(1978)-65732, and other various additives.

The present invention is further described by the following examples, but those examples are given by no means to restrict the invention.

EXAMPLE 1

A paper was laminated with polyethylene on the both sides to prepare a paper support (thickness: 100 μm). On the surface of the paper support, the following first to twelfth layers are provided to prepare a color photographic photosensitive material. The obtained photographic material (sample) was numbered as No. 101. Polyethylene laminated on the first layer side included anatase-type titanium oxide as a white pigment and an extremely small amount of ultramarine as a blue dye.

(Composition of layers)

The composition and its amount (g/m$^2$) of each layer are set forth below. The values for the silver halide emulsions mean the coating amount of silver.

| | |
|---|---|
| The first layer (Gelatin layer) | |
| Gelatin | 1.30 |
| The second layer (Antihalation layer) | |
| Black colloidal silver | 0.10 |
| Gelatin | 0.70 |
| The third layer (Low red sensitive layer) | |
| Silver chloroiodobromide spectrally sensitized with red sensitizing dye (mixture of ExS-1, 2, 3 in the ratio of 1:1:1) [silver chloride: 1 mole %; silver iodide: 4 mole %; mean grain size: 0.3 μm; size distribution: 10%; cubic; iodine core-type core shell] | 0.06 |
| Silver iodobromide spectrally sensitized with red sensitizing dye (mixture of ExS-1, 2, 3 in the ratio of 1:1:1) [silver iodide: 4 mole %; mean grain size: 0.5 μm; size distribution: 15%; cubic] | 0.10 |
| Gelatin | 1.00 |
| Cyan coupler (ExC-1) | 0.14 |
| Cyan coupler (ExC-2) | 0.07 |
| Discoloration inhibitor (mixture of Cpd-2, 3, 4 in the ratio of 1:1:1) | 0.12 |
| Coupler dispersion medium (Cpd-6) | 0.03 |
| Coupler solvent (mixture of Solv-1, 2, 3 in the ratio of 1:1:1) | 0.06 |
| Development accelerator (Cpd-13) | 0.05 |
| The fourth layer (High red sensitive layer) | |
| Silver iodobromide spectrally sensitized with red sensitizing dye (mixture of ExS-1, 2, 3 in the ratio of 1:1:1) [silver iodide: 6 mole %; mean grain size: 0.8 μm; size distribution: 20%; tabular (aspect ratio = 8, iodine core type] | 0.15 |
| Gelatin | 1.00 |
| Cyan coupler (ExC-1) | 0.20 |
| Cyan coupler (ExC-2) | 0.10 |
| Discoloration inhibitor (mixture of Cpd-2, 3, 4 in the ratio of 1:1:1) | 0.15 |
| Coupler dispersion medium (Cpd-6) | 0.03 |
| Coupler solvent (mixture of Solv-1, 2, 3 in the ratio of 1:1:1) | 0.10 |
| The fifth layer (Intermediate layer) | |
| Magenta colloidal silver | 0.02 |
| Gelatin | 1.00 |
| Color stain inhibitor (mixture of Cpd-7, 16 in the ratio of 1:1) | 0.08 |
| Color stain inhibitor solvent (mixture of Solv-4, 5 in the ratio of 1:1) | 0.16 |
| Polymer latex (Cpd-8) | 0.10 |
| The sixth layer (Low green sensitive layer) | |
| Silver chloroiodobromide spectrally sensitized with green sensitizing dye (ExS-4) [silver chloride: 1 mole %; silver iodide: 2.5 mole %; mean grain size: 0.28 μm; size distribution: 8%; cubic, iodine core type core shell] | 0.04 |
| Silver iodobromide spectrally sensitized with green sensitizing dye (ExS-4) [silver iodide: 2.5 mole %; mean grain size: 0.48 μm; size distribution: 12%; cubic] | 0.06 |
| Gelatin | 0.80 |
| Magenta coupler (mixture of ExM-1, 2 in the ratio of 1:1) | 0.10 |
| Discoloration inhibitor (Cpd-9) | 0.10 |
| Stain inhibitor (mixture of Cpd-10, 11 in the ratio of 1:1) | 0.01 |
| Stain inhibitor (Cpd-5) | 0.001 |
| Stain inhibitor (Cpd-12) | 0.01 |
| Coupler dispersion medium (Cpd-5) | 0.05 |
| Coupler solvent (mixture of Solv-4, 6 in the ratio of 1:1) | 0.15 |
| The seventh layer (High green sensitive layer) | |
| Silver iodobromide spectrally sensitized with green sensitizing dye (ExS-4) [silver iodide: 3.5 mole %; mean grain size: 1.0 μm; size distribution: 21%; tabular (aspect ratio = 9, iodine homogeneously-dispersed type] | 0.10 |
| Gelatin | 0.80 |
| Magenta coupler (mixture of ExM-1, 2 in the ratio of 1:1) | 0.10 |
| Discoloration inhibitor (Cpd-9) | 0.10 |
| Stain inhibitor (mixture of Cpd-10, 11, 22, in the ratio of 1:1:1) | 0.01 |
| Stain inhibitor (Cpd-5) | 0.001 |
| Stain inhibitor (Cpd-12) | 0.01 |
| Coupler dispersion medium (Cpd-6) | 0.05 |
| Coupler solvent (mixture of Solv-4, 6) | 0.15 |
| The eighth layer (Yellow filter layer) | |
| Yellow colloidal silver | 0.20 |
| Gelatin | 1.00 |
| Color stain inhibitor (Cpd-7) | 0.06 |
| Color stain inhibitor solvent (mixture of Solv-4, 5 in the ratio of 1:1) | 0.15 |
| Polymer latex (Cpd-8) | 0.10 |
| The ninth layer (Low blue sensitive layer) | |
| Silver chloroiodobromide spectrally sensitized with blue sensitizing dye (mixture of ExS-5, 6 in the ratio of 1:1) [silver chloride: 2 mole %; silver iodide: 2.5 mole %; mean grain size: 0.38 μm; size distribution: 8%; cubic; iodine core-type core shell] | 0.07 |
| Silver iodobromide spectrally sensitized with blue sensitizing dye (mixture of ExS-5, 6 in the ratio of 1:1) [silver iodobromide: 2.5 mole %; mean grain size: 0.55 μm; size distribution: 11%; cubic] | 0.10 |
| Gelatin | 0.50 |
| Yellow coupler (mixture of ExY-1, 2 in the ratio of 1:1) | 0.20 |
| Stain inhibitor (Cpd-5) | 0.001 |
| Discoloration inhibitor (Cpd-14) | 0.10 |
| Coupler dispersion medium (Cpd-6) | 0.05 |
| Coupler solvent (Solv-2) | 0.05 |
| The tenth layer (High blue sensitive layer) | |
| Silver iodobromide spectrally sensitized with blue sensitizing dye (mixture of ExS-5, 6 in the ratio of 1:1) [silver iodide: 2.5 mole %; mean grain size: 1.4 μm; size distribution: 21%; tabular (aspect ratio = 14)] | 0.25 |
| Gelatin | 1.00 |
| Yellow coupler (mixture of ExY-1, 2 in the ratio of 1:1) | 0.40 |
| Stain inhibitor (Cpd-5) | 0.002 |
| Discoloration inhibitor (Cpd-14) | 0.10 |
| Coupler dispersion medium (Cpd-6) | 0.15 |
| Coupler solvent (Solv-2) | 0.10 |
| The eleventh layer (Ultraviolet absorbing layer) | |
| Gelatin | 1.50 |
| Ultraviolet absorbent (mixture of Cpd-1, 2, 4, 15 in the ratio of 1:1:1:1) | 1.00 |
| Color stain inhibitor (mixture of Cpd-7, 16) | 0.06 |
| Dispersion medium (Cpd-6) | |
| Ultraviolet absorbent solvent (mixture of Solv-1, 2 in the ratio of 1:1) | 0.15 |
| Irradiation inhibiting dye (mixture of Cpd-17, 18 in the ratio of 1:1) | 0.02 |
| Irradiation inhibiting dye (mixture of Cpd-19, 20 in the ratio of 1:1) | 0.02 |
| The twelfth layer (Protective layer) | |
| Fine grains of silver chlorobromide [silver chloride: 97 mole %; mean grain size: 0.2 μm] | 0.07 |
| Modified POVAL | 0.02 |
| Gelatin | 1.50 |

-continued

| | |
|---|---|
| Gelatin hardening agent (mixture of H-1, 2 in the ratio of 1:1) | 0.17 |

Further, emulsifying dispersion aids of Alkanol XC (Trade name: Du Pont) and sodium alkylbenzene sulfonate, and coating aids of succinic acid ester and Megafac F120 (Trade name: Dainippon Ink & Chemicals Inc.) were also added to each layer. Stabilizers of Cpd-21, 22 and 23 were added to each of the layers containing silver halide or colloidal silver.

Followings are compounds used for preparation of the photographic material.

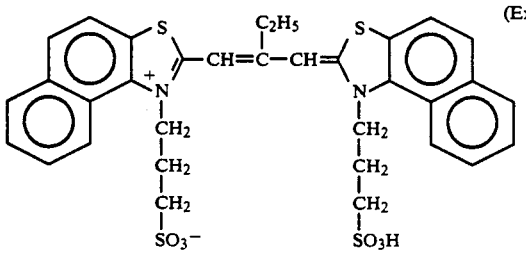

(ExS-1)

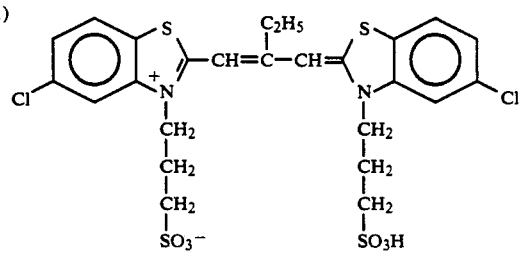

(ExS-2)

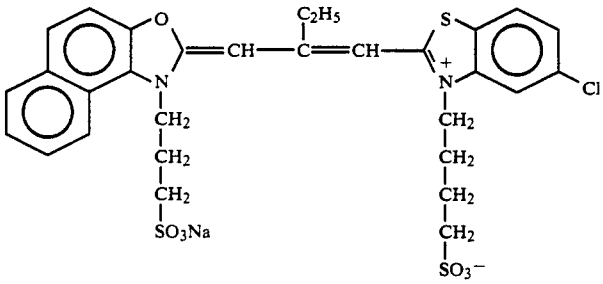

(ExS-3)

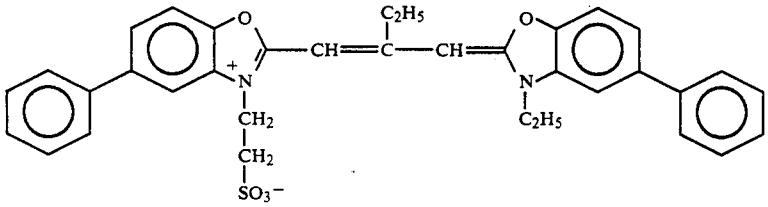

(ExS-4)

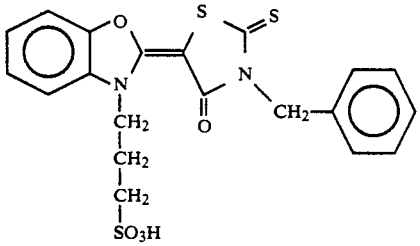

(ExS-5)

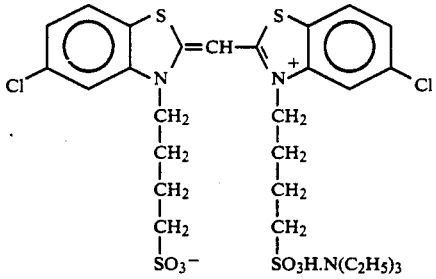

(ExS-6)

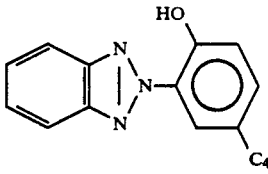

(Cpd-1)

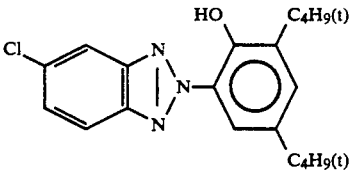

(Cpd-2)

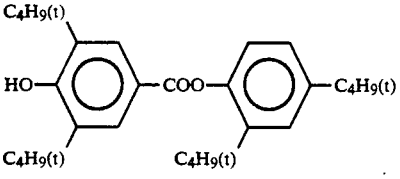

(Cpd-3)

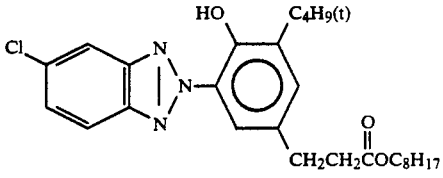

(Cpd-4)

-continued
(Cpd-5)
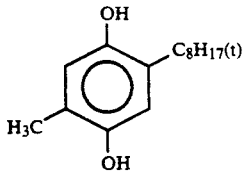
(Cpd-6)
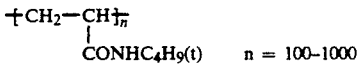
n = 100–1000
(Cpd-7)
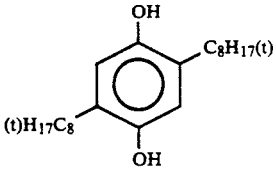
Polyethyl acrylate (MW = 10,000–100,000)
(Cpd-8)
(Cpd-9)
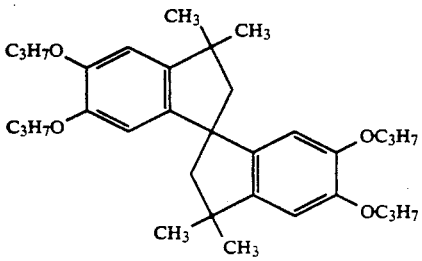
(Cpd-10)
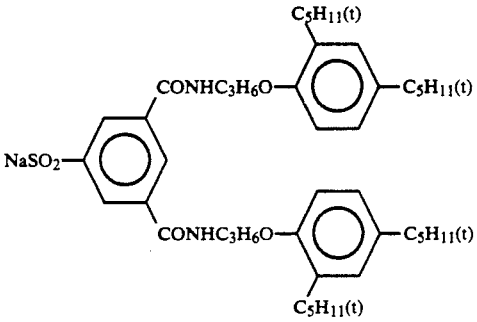
(Cpd-11)
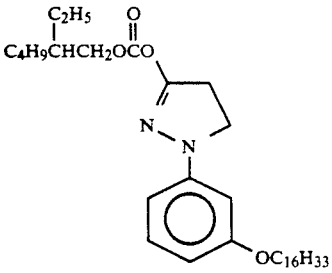
(Cpd-12)
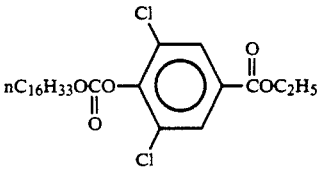
(Cpd-13)
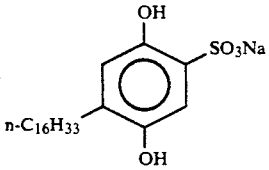
(Cpd-14)
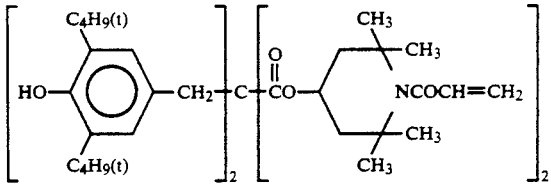
(Cpd-15)
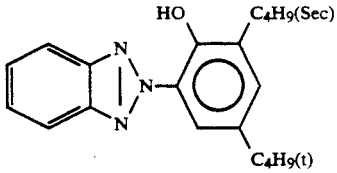
(Cpd-16)
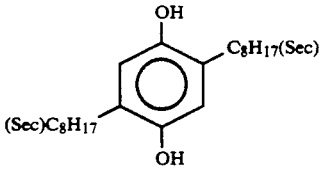
(Cpd-17)
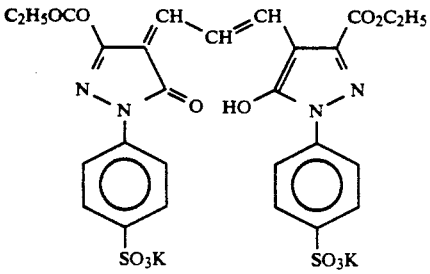
(Cpd-18)
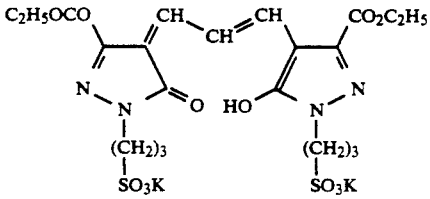

-continued
(Cpd-19)
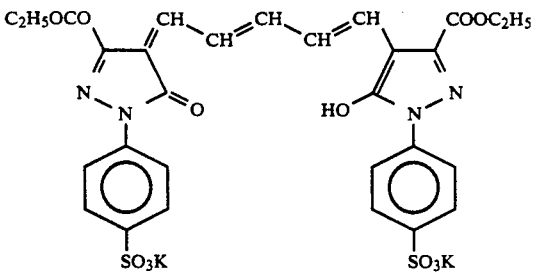
(Cpd-20)
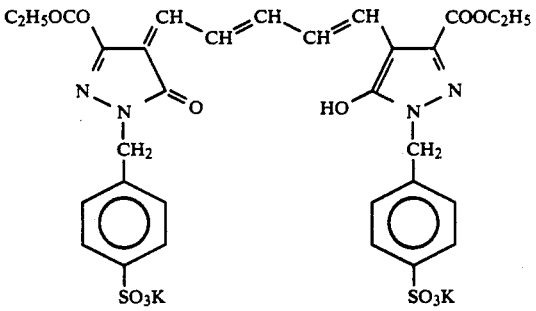
(Cpd-21)
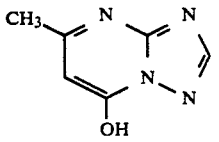
(Cpd-22)
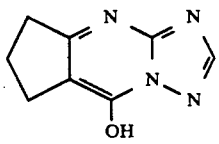
(Cpd-23)
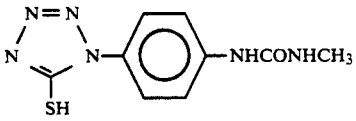
(ExC-1)
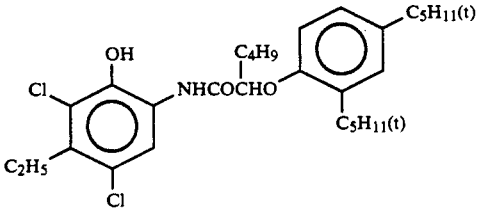
(ExC-2)
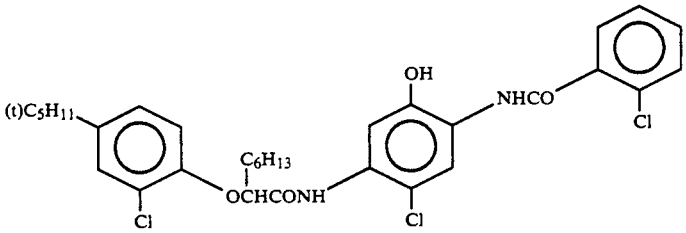
(ExM-1)
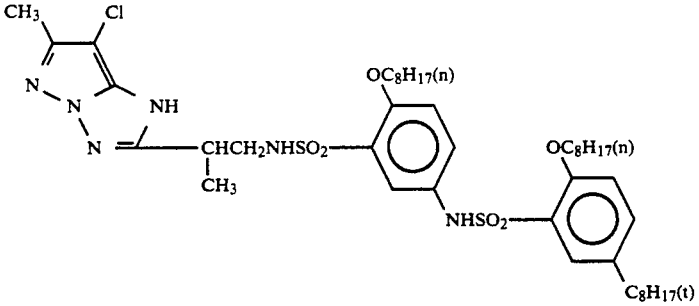
(ExM-2)
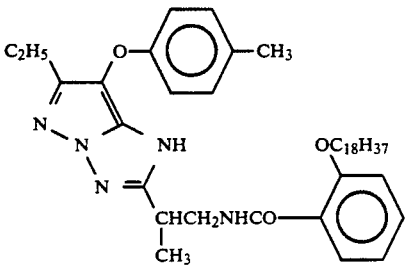

-continued

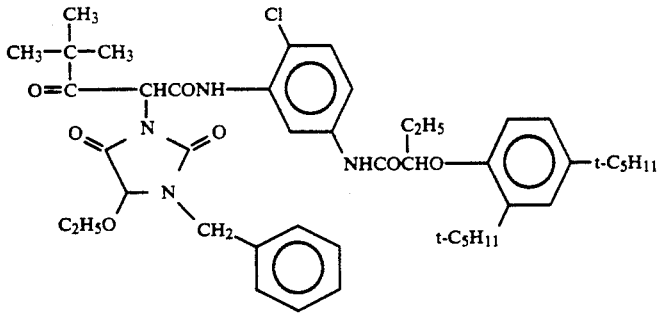

(ExY-1)

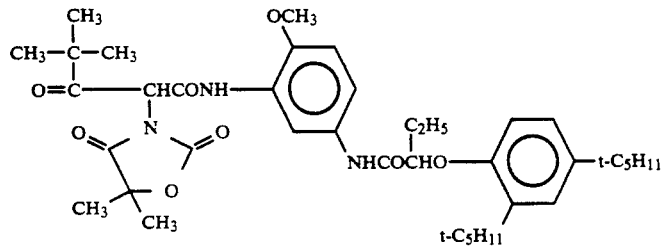

(ExY-2)

| | | | |
|---|---|---|---|
| Di(2-ethylhexyl)phthalate | (Solv-1) | Trinonyl phosphate | (Solv-2) |
| Di(3-methylhexyl)phthalate | (Solv-3) | Tricresyl phosphate | (Solv-4) |
| Dibutyl phthalate | (Solv-5) | Trioctyl phosphate | (Solv-6) |

$CH_2{=}CH{-}SO_2{-}CH_2{-}CONH{-}CH_2{-}CH_2{-}CONH{-}CH_2{-}SO_2{-}CH{=}CH_2$ (H-1)

Sodium salt of 4,6-dichloro-2-hydroxy-1,3,5-triazine (H-2)

The procedure of preparation of No. 101 was repeated except that the coating positions of the third layer (low red sensitive layer) and the fourth layer (high red sensitive layer) were replaced with each other, to prepare a sample of No. 102.

Further, the procedure of preparation of No. 101 or No. 102 was repeated except that the compounds of the invention set forth in Table 1 were added to the fifth layer (intermediate layer), to prepare samples of No. 103–No. 116.

Each of the samples No. 101 to No. 116 was exposed to red light through a continuous filter, and then subjected to the following developing process. Subsequently, each of the samples was exposed to white light (red light+green light+blue light) adjusting the three lights through continuous filter in such a manner that the developed sample became gray, and then subjected to the same developing process. The light amount of the red light in the red light exposure was the same as that of the red light in the white light exposure.

Thus developed each sample was measured in the density, and the difference of the light amount between in the red light exposure and in the white light exposure in the case that the cyan density was 0.6 was determined as the inter image effect for the red sensitive silver halide emulsion layer, namely ΔlogE (R). Likewise, the inter image effect for the green sensitive silver halide emulsion layer, namely, ΔlogE (G), was determined. The results are set forth in Table 1.

| Process | |
|---|---|
| First development (black and white development) | 38° C. 75 seconds |
| Washing | 38° C. 90 seconds |
| Reversal exposure | 100 lux or more 60 seconds or more |
| Color development | 38° C. 135 seconds |
| Washing | 38° C. 45 seconds |
| Bleach-fix | 38° C. 120 seconds |

-continued

| | |
|---|---|
| Washing | 38° C. 135 seconds |
| Drying | |

| Composition of processing liquid | |
|---|---|
| (First developing solution) | |
| Pentasodium nitrilo-N,N,N-trimethylenephosphonate | 0.6 g |
| Pentasodium diethylenetriaminepentaacetate | 4.0 g |
| Potassium sulfite | 30.0 g |
| Potassium thiocyanate | 1.2 g |
| Potassium carbonate | 35.0 g |
| Potassium hydroquinonemonosulfonate | 25.0 g |
| Diethylene glycol | 15.0 ml |
| 1-Phenyl-4-hydroxymethyl-4-methyl-3-pyrazolidone | 2.0 g |
| Potassium chloride | 0.5 g |
| Potassium iodide | 5.0 mg |
| Water to make up to 1 l | (pH: 9.70) |
| (Color developer) | |
| Benzyl alcohol | 15.0 ml |
| Diethylene glycol | 12.0 ml |
| 3,6-Dithia-1,8-octanediol | 0.2 g |
| Pentasodium nitrilo-N,N,N-trimethylenephosphonate | 0.5 g |
| Pentasodium diethylenetriaminepentaacetate | 2.0 g |
| Potassium carbonate | 25.0 g |
| Hydoxylaminesulfate | 3.0 g |
| N-ethyl-N-(β-methanesulfonamideethyl)-3-methyl-4-aminoanilinesulfate | 5.0 g |
| Potassium bromide | 0.5 g |
| Potassium iodide | 1.0 mg |
| Water to make up to 1 l | (pH: 10.40) |
| (Bleach-fix bath) | |
| 2-Mercapto-1,3,4-triazole | 1.0 g |
| Disodium ethylenediaminetetraacetate dihydrate | 5.0 g |
| Ammonium ethylenediaminetetraacetate Fe(III) monohydrate | 80.0 g |
| Sodium sulfite | 15.0 g |
| Sodium thiosulfate (700 g/l liquid) | 160.0 ml |
| Glacial acetic acid | 5.0 ml |
| Water to make up to 1 l | (pH: 6.50) |

In Table 1, as the value of ΔlogE (R) or ΔlogE (G) becomes larger, the inter image effect of higher level can be obtained, that is, such color photographic material exhibits a color reproducibility of high saturation.

As is evident from Table 1, the sample of the invention in which the compound of the invention was added to the fifth layer and a high red sensitive layer and a low red sensitive layer were provided as the third layer and the fourth layer, respectively, exhibited high inter image effect, that is, favorable result in color reproducibility can be obtained.

TABLE 1

| Sample No. | Third layer | Fourth layer | Compound & Amount added to 5th layer (mol/m$^2$) | ΔlogE (R) | ΔlogE (G) |
|---|---|---|---|---|---|
| 101 (Comp. Ex) | RL | RH | — | 0.10 | 0.16 |
| 102 (Comp Ex) | RH | RL | — | 0.12 | 0.15 |
| 103 (Comp. Ex) | RL | RH | (1a-3) $10^{-5}$ | 0.18 | 0.22 |
| 104 (Comp. Ex) | RL | RH | (1a-12) $5 \times 10^{-5}$ | 0.16 | 0.20 |
| 105 (Comp. Ex) | RL | RH | (1a-12) $10^{-5}$ | 0.20 | 0.25 |
| 106 (Comp. Ex) | RL | RH | (1a-12) $5 \times 10^{-5}$ | 0.23 | 0.28 |
| 107 (Comp. Ex) | RL | RH | (1a-13) $10^{-5}$ | 0.18 | 0.23 |
| 108 (Comp. Ex) | RL | RH | (1a-19) $10^{-5}$ | 0.16 | 0.21 |
| 109 (Comp. Ex) | RL | RH | (1a-29) $10^{-5}$ | 0.19 | 0.22 |
| 110 (Example) | RH | RL | (1a-3) $10^{-5}$ | 0.25 | 0.29 |
| 111 (Example) | RH | RL | (1a-12) $5 \times 10^{-5}$ | 0.23 | 0.27 |
| 112 (Example) | RH | RL | (1a-12) $10^{-5}$ | 0.26 | 0.32 |
| 113 (Example) | RH | RL | (1a-12) $5 \times 10^{-5}$ | 0.24 | 0.34 |
| 114 (Example) | RH | RL | (1a-13) $10^{-5}$ | 0.23 | 0.30 |
| 115 (Example) | RH | RL | (1a-19) $10^{-5}$ | 0.25 | 0.29 |
| 116 (Example) | RH | RL | (1a-29) $10^{-5}$ | 0.25 | 0.28 |

Remark: RH and RL mean a high red sensitive layer and a low red sensitive layer, respectively.

After exposed to white light though continuous filter, each of the samples No. 101 to No. 116 was subjected to the first developing process (black and white developing process) in Example 1 for periods of time of 45 seconds and 75 seconds. Thus developed each sample was measured on the cyan color density to obtain such a characteristic curve as shown in FIG. 1. When the cyan color density on the unexposed area was made "D max" and the cyan color density on the area where the light amount of the exposure was insufficient was made "D min", a tangent line was drawn on the characteristic curve at the point where the cyan color density was D min+(D max−D min)/3, and reversed signs of plus and minus signs on the inclination of the tangent line were referred to gamma. Gamma is an index expressing gradient.

In Table 2 are set forth values of gamma obtained in cases where the periods of time for the first developing process are 45 seconds and 75 seconds.

As is evident from Table 2, the samples (No. 103 to No. 109) only containing the compound of the invention in the fifth layer had a relatively large variation in the gamma value obtained when the periods of time for the first developing process are 45 seconds and 75 seconds, resulting in deterioration of stability for processing variation. On the other hand, the samples (No. 110 to No. 116) in which the compound of the invention is contained in the fifth layer and a high red sensitive layer and a low red sensitive layer are provided as the third layer and the fourth layer, respectively, had a small variation in the gamma value obtained when the periods of time for the first developing process are 45 seconds and 75 seconds, resulting in high stability for processing variation.

TABLE 2

| Sample No. | Sample of Cyan Color Image: First developing time: 45 sec. | First developing time: 75 sec. |
|---|---|---|
| 101 (Comp. Ex) | 1.60 | 1.45 |
| 102 (Comp. Ex) | 1.57 | 1.50 |
| 103 (Comp. Ex) | 1.70 | 1.47 |
| 104 (Comp. Ex) | 1.72 | 1.46 |
| 105 (Comp. Ex) | 1.65 | 1.48 |
| 106 (Comp. Ex) | 1.73 | 1.50 |
| 107 (Comp. Ex) | 1.80 | 1.52 |
| 108 (Comp. Ex) | 1.70 | 1.48 |
| 109 (Comp. Ex) | 1.69 | 1.47 |
| 110 (Example) | 1.53 | 1.50 |
| 111 (Example) | 1.54 | 1.51 |
| 112 (Example) | 1.50 | 1.49 |
| 113 (Example) | 1.53 | 1.50 |
| 114 (Example) | 1.55 | 1.52 |
| 115 (Example) | 1.53 | 1.49 |
| 116 (Example) | 1.56 | 1.50 |

EXAMPLE 2

Preparation of Sample No. 201

On a cellulose triacetate film support (thickness: 127 μm) having been subjected to undercoating were provided the following layers, to prepare a multilayer color photographic material. The obtained photographic material was numbered as sample No. 201. The amount of the composition of each layer set forth below is an amount based on 1 m$^2$. The effects given by the compounds added to the layers are by no means restricted to purposes described below.

| | |
|---|---|
| The first layer: antihalation layer | |
| Black colloidal silver | 0.25 g |
| Gelatin | 1.9 g |
| Ultraviolet absorbent (U-1) | 0.04 g |
| Ultraviolet absorbent (U-2) | 0.1 g |
| Ultraviolet absorbent (U-3) | 0.1 g |
| Ultraviolet absorbent (U-6) | 0.1 g |
| High boiling organic solvent (Oil-1) | 0.1 g |
| The second layer: intermediate layer | |
| Gelatin | 0.40 g |
| High boiling organic solvent (Oil-3) | 40 mg |
| The third layer: intermediate layer | |
| Fogged fine grain silver iodobromide emulsion [mean grain size: 0.06 μm; content of AgI: 1 mole %]; in terms of silver | 0.05 g |
| Gelatin | 0.4 g |
| The fourth layer: low red sensitive emulsion layer | |
| Silver iodobromide emulsion spectrally sensitized with sensitizing dyes S-1 and S-2 [mixture of cubic grain-monodispersed type of mean grain size of 0.3 μm and AgI content of 4.5 mole % and cubic grain monodispersed type of mean grain size of 0.3 μm and AgI content of 4.6 mole %, in the ratio of 1;1]; in terms of silver | 0.4 g |
| Gelatin | 0.8 g |
| Coupler (C-1) | 0.20 g |
| Coupler (C-9) | 0.05 g |
| High boiling organic solvent (Oil-2) | 0.10 g |
| The fifth layer: middle red sensitive emulsion layer | |
| Silver iodobromide emulsion spectrally sensitized with sensitizing dyes S-1 and S-2 [cubic grain monodispersed type; mean grain size: 0.45 μm; AgI content: mole %]; in terms of silver | 0.4 g |

-continued

| | |
|---|---|
| Gelatin | 0.8 g |
| Coupler (C-1) | 0.2 g |
| Coupler (C-2) | 0.05 g |
| Coupler (C-3) | 0.2 g |
| High boiling organic solvent (Oil-1) | 0.1 g |
| The sixth layer: high red sensitive emulsion layer | |
| Silver iodobromide emulsion spectrally sensitized with sensitizing dyes S-1 and S-2 [twinned crystal grain monodispersed type; mean grain size: 0.65 μm; AgI content: 2 mole %]; in terms of silver | 0.4 g |
| Gelatin | 1.1 g |
| Coupler (C-3) | 0.7 g |
| Coupler (C-1) | 0.3 g |
| The seventh layer: intermediate layer | |
| Gelatin | 1.6 g |
| Dye (D-1) | 0.02 g |
| Fogged silver iodobromide emulsion [mean grain size: 0.06 μm; AgI content: 0.3 mole %] | 0.02 g |
| Color stain inhibitor (Cpd-A) | 0.2 g |
| The eighth layer: low green sensitive emulsion layer | |
| Silver iodobromide emulsion spectrally sensitized with sensitizing dyes S-3 and S-4 [mixture of cubic grain monodispersed type of mean grain size of 0.4 μm and AgI content of 4.0 mole % and cubic grain monodispersed type of mean grain size of 0.25 μm and AgI content of 4.5 mole %, in the ratio of 1;1]; in terms of silver | 0.5 g |
| Gelatin | 0.5 g |
| Coupler (C-4) | 0.20 g |
| Coupler (C-7) | 0.10 g |
| Coupler (C-8) | 0.10 g |
| Compound (Cpd-B) | 0.03 g |
| Compound (Cpd-D) | 0.02 g |
| Compound (Cpd-E) | 0.02 g |
| Compound (Cpd-F) | 0.02 g |
| Compound (Cpd-G) | 0.02 g |
| High boiling organic solvent (Oil-1) | 0.1 g |
| High boiling organic solvent (Oil-2) | 0.1 g |
| The ninth layer: middle green sensitive emulsion layer | |
| Silver iodobromide emulsion spectrally sensitized with sensitizing dyes S-3 and S-4 [cubic grain monodispersed type; mean grain size: 0.35 μm; AgI content: 2 mole %]; in terms of silver | 0.4 g |
| Gelatin | 0.6 g |
| Coupler (C-4) | 0.1 g |
| Coupler (C-7) | 0.1 g |
| Coupler (C-8) | 0.1 g |
| Compound (Cpd-B) | 0.03 g |
| Compound (Cpd-D) | 0.02 g |
| Compound (Cpd-E) | 0.02 g |
| Compound (Cpd-F) | 0.05 g |
| Compound (Cpd-G) | 0.05 g |
| High boiling organic solvent (Oil-2) | 0.01 g |
| The tenth layer: high green sensitive emulsion layer | |
| Silver iodobromide emulsion spectrally sensitized with sensitizing dyes S-3 and S-4 [tabular grain monodispersed type; mean grain size in terms of sphere: 0.7 μm; AgI content: 1.3 mole %; mean value of diameter/thickness: 7]; in terms of silver | 0.5 g |
| Gelatin | 1.0 g |
| Coupler (C-4) | 0.4 g |
| Coupler (C-7) | 0.2 g |
| Coupler (C-8) | 0.2 g |
| Compound (Cpd-B) | 0.08 g |
| Compound (Cpd-D) | 0.02 g |
| Compound (Cpd-E) | 0.02 g |
| Compound (Cpd-F) | 0.02 g |
| Compound (Cpd-G) | 0.02 g |
| High boiling organic solvent (Oil-1) | 0.02 g |
| High boiling organic solvent (Oil 2) | 0.02 g |
| The eleventh layer: intermediate layer | |
| Gelatin | 0.6 g |
| Dye (D-2) | 0.05 g |
| The twelfth layer: yellow filter layer | |
| Yellow colloidal silver (in terms of silver) | 0.1 g |
| Gelatin | 1.1 g |
| Color stain inhibitor (Cpd-A) | 0.01 g |
| High boiling organic solvent (Oil-1) | 0.01 g |
| The thirteenth layer: intermediate layer | |
| Gelatin | 0.6 g |

-continued

| | |
|---|---|
| The fourteenth layer: low blue sensitive emulsion layer | |
| Silver iodobromide emulsion spectrally sensitized with sensitizing dyes S-5 and S-6 [mixture of cubic grain monodispersed type of mean grain size of 0.4 μm and AgI content of 3 mole % and cubic grain monodispersed type of mean grain size of 0.3 μm and AgI content of 3 mole %, in the ratio of 1;1]; in terms of silver | 0.6 g |
| Gelatin | 0.8 g |
| Coupler (C-5) | 0.6 g |
| High boiling organic solvent (Oil-2) | 0.02 g |
| The fifteenth layer: middle blue sensitive emulsion layer | |
| Silver iodobromide emulsion spectrally sensitized with sensitizing dyes S-5 and S-6 [cubic grain monodispersed type; mean grain size: 0.6 μm; AgI content: 2 mole %]; in terms of silver | 0.4 g |
| Gelatin | 0.9 g |
| Coupler (C-5) | 0.3 g |
| Coupler (C-6) | 0.3 g |
| High boiling organic solvent (Oil-2) | 0.02 g |
| The sixteenth layer: high blue sensitive emulsion layer | |
| Silver iodobromide emulsion spectrally sensitized with sensitizing dyes S-5 and S-6 [tabular grain mono dispersed type; mean grain size in terms of sphere: 0.7 μm; AgI content: 1.5 mole %; mean value of diameter/thickness: 7]; in terms of silver | 0.4 g |
| Gelatin | 1.2 g |
| Coupler (C-6) | 0.7 g |
| The seventeenth layer: first protective layer | |
| Gelatin | 0.7 g |
| Ultraviolet absorbent (U-1) | 0.04 g |
| Ultraviolet absorbent (U-3) | 0.03 g |
| Ultraviolet absorbent (U-4) | 0.03 g |
| Ultraviolet absorbent (U-5) | 0.05 g |
| Ultraviolet absorbent (U-6) | 0.05 g |
| High boiling organic solvent (Oil-1) | 0.02 g |
| Formalin scavenger (Cpd-C) | 0.8 g |
| Dye (D-3) | 0.05 g |
| The eighteenth layer: second protective layer | |
| Fogged fine grain silver iodobromide emulsion [mean grain size: 0.06 μm; AgI content: 1 mole %]; in terms of silver | 0.1 g |
| Gelatin | 0.4 g |
| The nineteenth layer: third protective layer | |
| Gelatin | 0.4 g |
| Polymethyl methacylate (mean particle size: 1.5 μm) | 0.1 g |
| Methyl methacrylate.acrylic acid copolymer (methyl methacylate : acrylic acid = 4:6, mean particle size: 1.5 μm) | 0.1 g |
| Silicone oil | 0.03 g |
| Surface active agent (W-1) | 3.0 mg |

To each of the above layers, a gelatin hardening agent (H-1) and coating and emulsifying surface active agents were added in addition to the above composition. In the emulsions used herein, the terms "monodispersed type" means that the emulsion has a coefficient of variation of not more than 20%.

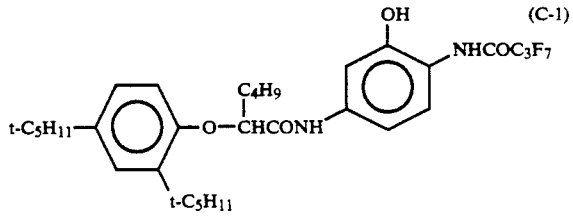

-continued
(C-2)
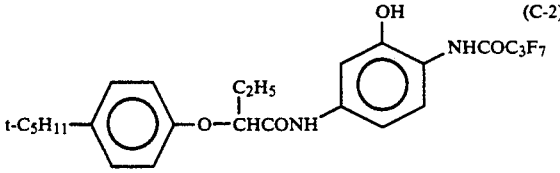
(C-3)
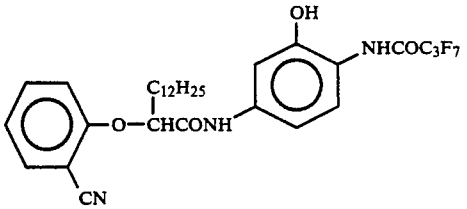
(C-4)
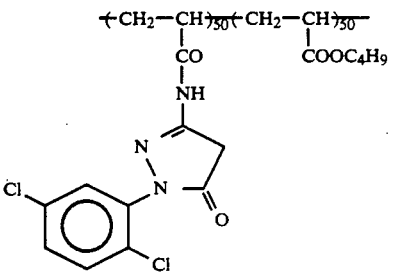
(numeral: wt. %)
(average molecular weight: about 25,000)
(C-5)
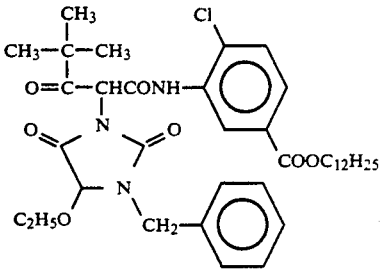
(C-6)
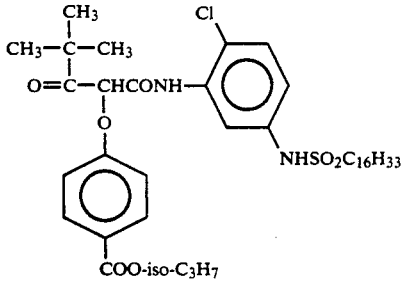
(C-7)
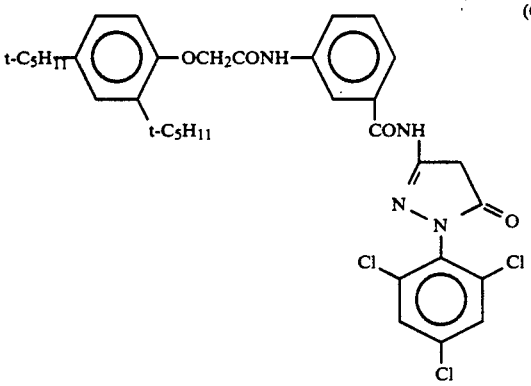
-continued
(C-8)
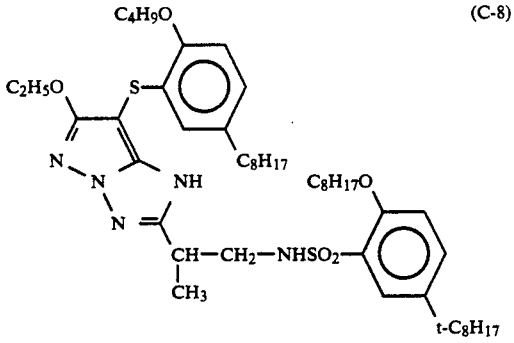
(C-9)
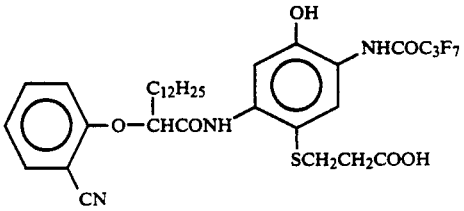
Dibutyl phthalate (Oil-1)
Tricresyl phosphate (Oil-2)
(Oil-3)
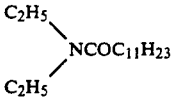
(Cpd-A)
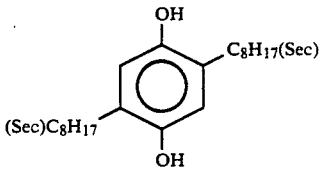
(Cpd-B)
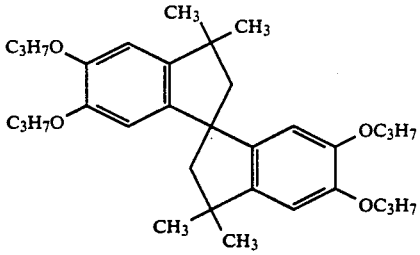
(Cpd-C)
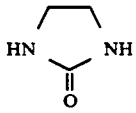
(Cpd-D)
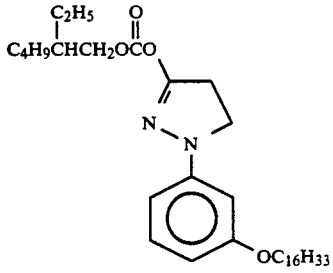

-continued
(Cpd-E)
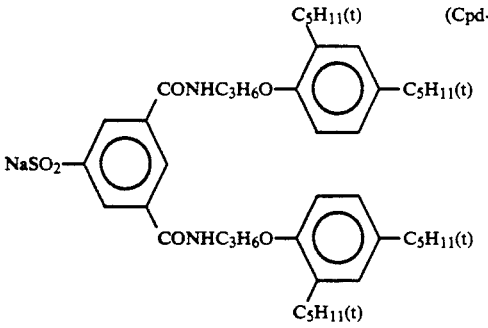
(Cpd-F)
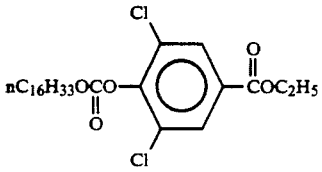
(Cpd-G)
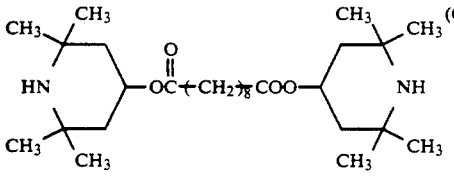
(U-1)
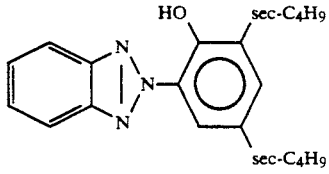
(U-2)
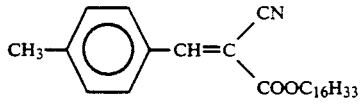
(U-3)
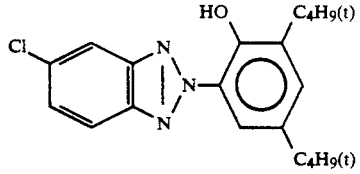
(U-4)
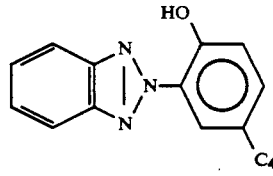
(U-5)
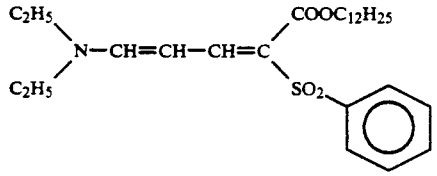
-continued
(U-6)
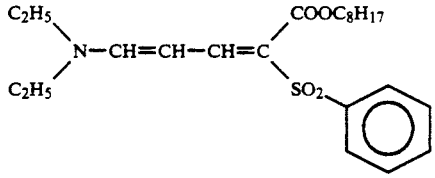
(S-1)
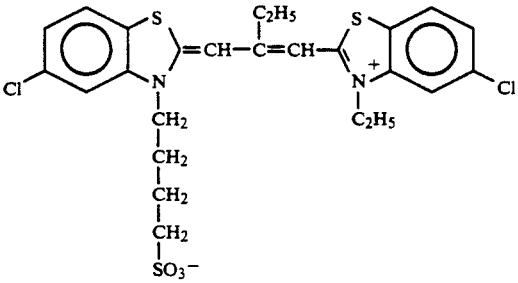
(S-2)
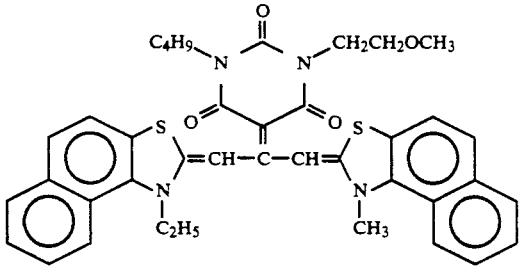
(S-3)
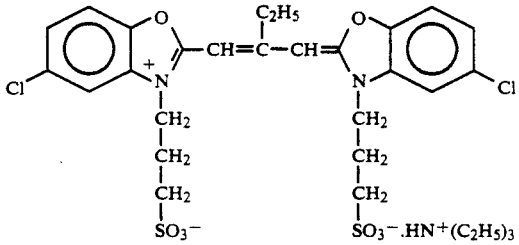
(S-4)
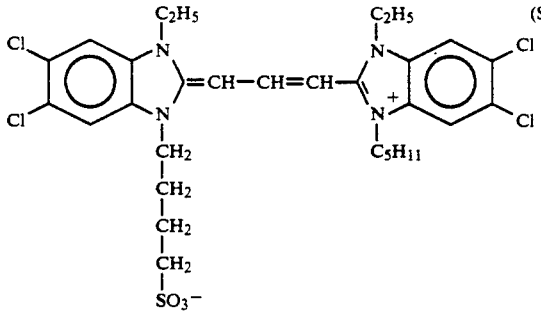
(S-5)
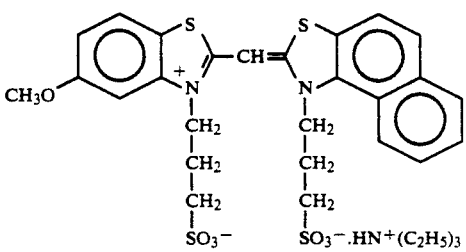

-continued (S-6)

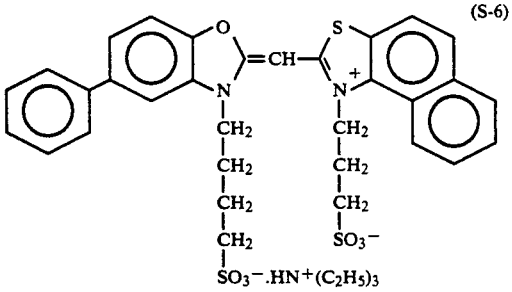

(D-1)

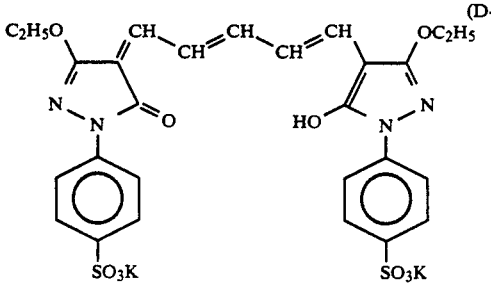

(D-2)

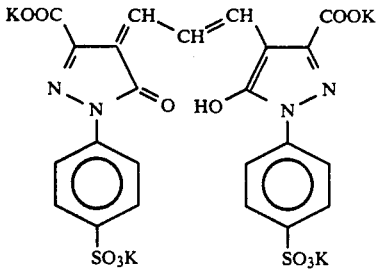

(D-3)

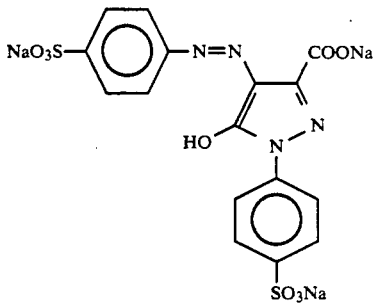

(H-1)

(W-1)

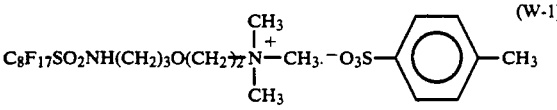

The procedure of preparation of No. 201 was repeated except that the order of the fourth layer (low red sensitive layer), the fifth layer (middle red sensitive layer) and the sixth layer (high red sensitive layer) was replaced with the order of the fourth layer (high red sensitive layer), the fifth layer (middle red sensitive layer) and the sixth layer (low red sensitive layer), to prepare a sample of No. 202.

Further, the procedure of preparation of No. 201 was repeated except that the fourth layer (middle red sensitive layer), the fifth layer (high red sensitive layer) and the sixth layer (low red sensitive layer) were provided in this order, to prepare a sample of No. 203.

Furthermore, the procedure of preparation of No. 201, No. 202 or No. 203 was repeated except for adding the compounds of the invention set forth in Table 3 to the seventh layer (intermediate layer), to prepare samples of No. 204 to No. 215.

Each of the samples No. 201 to No. 215 was exposed to red light through continuous filter, and then subjected to the following developing process. Subsequently, each sample was exposed to white light (red light + green light + blue light) adjusting the three lights through continuous filter in such a manner that the developed sample became gray, and then subjected to the same developing process. The light amount of the red light in the red light exposure was the same as that of the red light in the white light exposure.

Thus developed each sample was measured in the density, and the difference of the light amount between in the red light exposure and in the white light exposure in the case that the cyan density was 1.0 was determined as inter image effect for the red sensitive silver halide emulsion layer, namely, ΔlogE (R). Likewise, inter image effect for the green sensitive silver halide emulsion layer, namely, ΔlogE (G), was determined. The results are set forth in Table 3.

[Process]

| Process | Period (min) | Temperature (°C.) | Volume of the Tank (l) | Replenisher (l/m²) |
|---|---|---|---|---|
| Black and white Development | 6 | 38 | 12 | 2.2 |
| Washing (1) | 2 | 38 | 4 | 7.5 |
| Reversing | 2 | 38 | 4 | 1.1 |
| Color Development | 6 | 38 | 12 | 2.2 |
| Compensation | 2 | 38 | 4 | 1.1 |
| Bleaching | 6 | 38 | 12 | 0.22 |
| Fixing | 4 | 38 | 8 | 1.1 |
| Washing (2) | 4 | 38 | 8 | 7.5 |
| Stabilizing | 1 | 25 | 2 | 1.1 |

Followings are the composition of each processing liquid.

Black and white Developer

| | Mother liquid | Replenisher |
|---|---|---|
| Pentasodium nitrilo-N,N,N-trimethylene phosphonate | 2.0 g | 2.0 g |
| Sodium sulfite | 30 g | 30 g |
| Potassium hydroquinone monosulfonate | 20 g | 20 g |
| Potassium carbonate | 33 g | 33 g |
| 1-Phenyl-1-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make up to | 1,000 ml | 1,000 ml |
| pH | 9.60 | 9.60 |

pH was adjusted using hydrochloric acid or potassium hydroxide.

| Reversing bath | Mother liquid | Replenisher (Same as mother liquid) |
|---|---|---|
| Pentasodium nitrilo-N,N,N-trimethylene phosphonate | 3.0 g | |
| Stannous chloride dihydrate | 1.0 g | |
| P-aminophenol | 0.1 g | |
| Sodium hydroxide | 8 g | |
| Glacial acetic acid | 15 ml | |
| Water to make up to | 1,000 ml | |
| pH | 6.00 | |

The pH was adjusted using hydrochloric acid or sodium hydroxide.

| Color Developer | Mother liquid | Replenisher |
|---|---|---|
| Pentasodium nitrilo-N,N,N-trimethylene phosphonate | 2.0 g | 2.0 g |
| Sodium sulfite | 7.0 g | 7.0 g |
| Tetrasodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-(b-methanesulfoneamideethyl)-3-methyl-4-aminoaniline sulfate | 11 g | 11 g |
| 3,6-dithia-1,8-octanediol | 1.0 g | 1.0 g |
| Water to make up to | 1,000 ml | 1,000 ml |
| pH | 11.80 | 12.00 |

The pH was adjusted using hydrochloric acid or potassium hydroxide.

| Compensating bath | Mother liquid | Replenisher (Same as mother liquid) |
|---|---|---|
| Disodium ethylenediaminetetraacetate dihydrate | 8.0 g | |
| Sodium sulfite | 12 g | |
| 1-Thioglycerol | 0.4 ml | |
| Sorbitan ester* | 0.1 g | |
| Water to make up to | 1,000 ml | |
| pH | 6.20 | |

pH was adjusted using hydrochloric acid or sodium hydroxide.

| Bleaching Bath | Mother liquid | Replenisher |
|---|---|---|
| Disodium ethylenediamine-tetraacetate dihydrate | 2.0 g | 4.0 g |
| Ammonium ethylenediaminetetraacetate Fe(III) dihydrate | 120 g | 240 g |
| Potassium bromide | 100 g | 20 g |
| Ammonium nitrate | 10 g | 20 g |
| Water to make up to | 1,000 ml | 1,000 ml |
| pH | 5.70 | 5.50 |

The pH was adjusted using hydrochloric acid or sodium hydroxide.

| Fixing Bath | Mother liquid | Replenisher (Same as mother liquid) |
|---|---|---|
| Ammonium thiosulfate | 8.0 g | |
| Sodium sulfite | 5.0 g | |
| Sodium bisulfite | 5.0 g | |
| Water to make up to | 1,000 ml | |
| pH | 6.60 | |

The pH was adjusted using hydrochloric acid or ammonia water.

| Stabilizing Bath | Mother liquid | Replenisher (Same as mother liquid) |
|---|---|---|
| Formalin (37%) | 5.0 ml | |
| Polyoxyethylene-p-monophenyl ether (mean polymerization degree: 10) | 0.5 ml | |
| Water to make up to | 1,000 ml | |
| pH | not adjusted | |

Sorbitan ester*

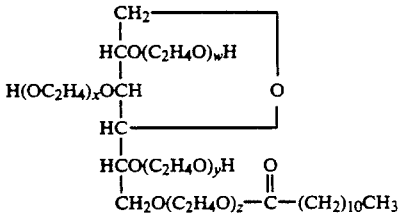

(w + x + y + z = 20)

As is evident from Table 3, the samples of the invention exhibited high inter image effect and favorable results in the color reproducibility were obtained.

TABLE 3

| Sample No. | 4th layer | 5th layer | 6th layer | Compound & Amount added to 7th layer (mol/m$^2$) | ΔlogE (R) | ΔlogE (G) |
|---|---|---|---|---|---|---|
| 201 (Comp. Ex) | RL | RM | RH | — | 0.20 | 0.25 |
| 202 (Comp. Ex) | RH | RM | RL | — | 0.21 | 0.26 |
| 203 (Comp. Ex) | RM | RH | RL | — | 0.20 | 0.25 |
| 204 (Comp. Ex) | RL | RL | RH | 1a-3 $5 \times 10^{-6}$ | 0.25 | 0.30 |
| 205 (Comp. Ex) | RL | RL | RH | 1a-12 $5 \times 10^{-6}$ | 0.26 | 0.31 |
| 206 (Comp. Ex) | RL | RL | RH | 1a-13 $5 \times 10^{-6}$ | 0.24 | 0.29 |
| 207 (Comp. Ex) | RL | RL | RH | 1a-29 $5 \times 10^{-6}$ | 0.25 | 0.30 |
| 208 (Example) | RH | RH | RL | 1a-3 $5 \times 10^{-6}$ | 0.31 | 0.36 |
| 209 (Example) | RH | RH | RL | 1a-12 $5 \times 10^{-6}$ | 0.32 | 0.37 |
| 210 (Example) | RH | RH | RL | 1a-13 $5 \times 10^{-6}$ | 0.31 | 0.35 |
| 211 (Example) | RH | RH | RL | 1a-29 $5 \times 10^{-6}$ | 0.30 | 0.35 |
| 212 (Example) | RM | RM | RL | 1a-3 $5 \times 10^{-6}$ | 0.29 | 0.35 |
| 213 (Example) | RM | RM | RL | 1a-12 $5 \times 10^{-6}$ | 0.32 | 0.36 |
| 214 (Example) | RM | RM | RL | 1a-13 $5 \times 10^{-6}$ | 0.30 | 0.34 |
| 215 | RM | RM | RL | 1a-29 $5 \times 10^{-6}$ | 0.29 | 0.34 |

TABLE 3-continued

| Sample No. | 4th layer | 5th layer | 6th layer | Compound & Amount added to 7th layer (mol/m$^2$) | ΔlogE (R) | ΔlogE (G) |
|---|---|---|---|---|---|---|
| (Example) | | | | | | |

Remark: RH, RM and RL mean a high red sensitive layer, a middle red sensitive layer and a low red sensitive layer, respectively.

EXAMPLE 3

The sample No. 101 used in Example 1 was prepared again as the sample No. 301. The procedure of preparation of No. 301 was repeated except that the fifth layer was varied as shown in Table 4, to prepare samples of No. 302–No. 329.

TABLE 4

| Sample No. | Compound of Formula (1a) or Formula (1b) Kind | Amount (mg/m$^2$) | Compound of Formula (2) Kind | Amount (mg/m$^2$) | Thickness (μm) |
|---|---|---|---|---|---|
| 301 (Comp. Ex) | — | — | Cpd7, 16 | 0.08 | 1.1 |
| 302 (Comp. Ex) | — | — | — | — | 1.1 |
| 303 (Comp. Ex) | — | — | Cpd7, 16 | 0.08 | 0.6 |
| 304 (Comp. Ex) | 1a-12 | 40 | — | — | 0.6 |
| 305 (Example) | 1a-12 | 40 | Cpd-7 | 0.08 | 0.6 |
| 306 (Example) | 1a-12 | 40 | 2-11 | 0.08 | 0.6 |
| 307 (Example) | 1a-12 | 40 | 2-16 | 0.08 | 0.6 |
| 308 (Example) | lb-1 | 30 | 2-6 | 0.07 | 0.6 |
| 309 (Example) | lb-1 | 30 | 2-20 | 0.08 | 0.6 |
| 310 (Example) | lb-1 | 30 | 2-23 | 0.09 | 0.6 |
| 312 (Comp. Ex) | Cpd-101 | 0.3 | Cpd-7 | 0.08 | 0.6 |
| 313 (Comp. Ex) | Cpd-101 | 3 | Cpd-7 | 0.08 | 0.6 |
| 314 (Comp. Ex) | Cpd-101 | 30 | Cpd-7 | 0.08 | 0.6 |
| 315 (Comp. Ex) | Cpd-101 | 300 | Cpd-7 | 0.08 | 0.6 |
| 316 (comp. Ex) | Cpd-101 | 30 | — | — | 0.6 |
| 317 (Comp. Ex) | Cpd-102 | 30 | Cpd-16 | 0.08 | 0.6 |
| 318 (Example) | 1a-12 | 0.4 | Cpd-16 | 0.08 | 0.6 |
| 319 (Example) | 1a-12 | 4 | Cpd-16 | 0.08 | 0.6 |
| 320 (Example) | 1a-12 | 40 | Cpd-16 | 0.08 | 0.6 |
| 321 (Example) | 1a-12 | 400 | Cpd-16 | 0.08 | 0.6 |
| 322 (Example) | 1a-12 | 40 | 2-16 | 0.01 | 0.6 |
| 323 (Example) | 1a-12 | 40 | 2-16 | 0.04 | 0.6 |
| 324 (Example) | 1a-12 | 40 | 2-16 | 0.16 | 0.6 |
| 325 (Example) | 1a-12 | 40 | 2-16 | 0.60 | 0.6 |
| 326 (Comp. Ex) | 1a-12 | 40 | 2-16 | 0.08 | 3.0 |
| 327 (Comp. Ex) | 1a-12 | 40 | 2-16 | 0.08 | 1.1 |
| 328 (Example) | 1a-12 | 40 | 2-16 | 0.08 | 0.8 |
| 329 (Example) | 1a-12 | 40 | 2-16 | 0.08 | 0.4 |

In Table 4, the expression "Cpd-7,16" means a mixture of Cpd-7 and Cpd-16 in the ratio of 1:1.

In Table 4, Cpd-101 and Cpd-102 are the following compounds.

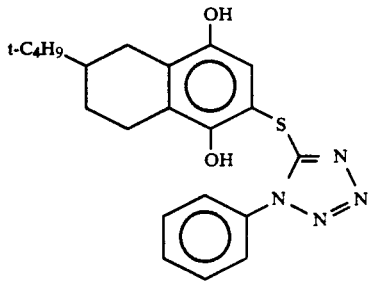

(Cpd-101)

-continued

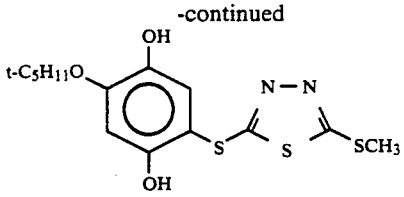

(Cpd-102)

Each of the samples No. 301 to No. 329 was optically exposed and then subjected the following processes. Then, each sample was measured on the sensitivity, tendency of color stain and CTF. The results are set forth in Table 5.

| | Process |
|---|---|
| First developing (black and white developing) | 38° C., 75 sec. |
| Washing | 38° C., 90 sec. |
| Reversal exposure | 100 lux or more, 10 sec. or more |
| Color developing | 38° C., 135 sec. |
| Washing | 38° C., 45 sec. |
| Bleach-fix | 38° C., 120 sec. |
| Washing | 38° C., 135 sec. |
| Drying | |

| Composition of processing liquid | |
|---|---|
| (First developer) | |
| Pentasodium nitrilo-N,N,N-trimethylenephosphonate | 0.6 g |
| Pentasodium diethylenetriaminepentaacetate | 4.0 g |
| Potassium sulfite | 30.0 g |
| Potassium thiocyanate | 1.2 g |
| Potassium carbonate | 35.0 g |
| Potassium hydroquinonemonosulfonate | 25.0 g |
| Diethylene glycol | 15.0 ml |
| 1-phenyl-4-hydroxymethyl-4-methyl-3-pyrazolidone | 2.0 g |
| Potassium bromide | 0.5 g |
| Potassium iodide | 5.0 mg |
| Water to make up to | 1 l |
| | (pH; 9.70) |
| (Color developer) | |
| Benzyl alcohol | 15.0 ml |
| Diethylene glycol | 12.0 ml |
| 3,6-dithia-1,8-octanediol | 0.2 g |
| Pentasodium nitrilo-N,N,N-trimethylenephosphonate | 0.5 g |
| Pentasodium diethylenetriaminepentaacetate | 2.0 g |
| Sodium sulfite | 2.0 g |
| Potassium carbonate | 25.0 g |
| Hydoxylaminesulfate | 3.0 g |
| N-ethyl-N-(β-methanesulfonanideethyl)-3-methyl-4-aminoanilinesulfate | 5.0 g |
| Potassium bromide | 0.5 g |
| Potassium iodide | 1.0 mg |
| Water to make up to | 1 l |
| | (pH: 10.40) |
| (Bleach-fix bath) | |
| 2-Mercapto-1,3,4-triazole | 1.0 g |
| Disodium ethylenediaminetetraacetate dihydrate | 5.0 g |
| Ammonium ethylenediaminetetraacetate Fe(III) monohydrate | 80.0 g |
| Sodium sulfite | 15.0 g |
| Sodium thiosulfate (700 g/l liquid) | 160.0 ml |
| Glacial acetic acid | 5.0 ml |
| Water to make up to | 1 l |
| | (pH: 6.50) |

TABLE 5

| Sample No. | Sharpness (10 cycle/mm) R | G | Storage Properties (ΔSo.7) R | G | Rapid Process (Dmin) | Color Stain D (R) |
|---|---|---|---|---|---|---|
| 301 (Comp. Ex) | 0.40 | 0.43 | −0.02 | −0.02 | 0.18 | 0.04 |
| 302 (Comp. Ex) | 0.40 | 0.44 | −0.01 | −0.02 | 0.20 | 0.12 |
| 303 (Comp. Ex) | 0.48 | 0.47 | −0.01 | −0.01 | 0.10 | 0.11 |
| 304 (Comp. Ex) | 0.49 | 0.47 | −0.02 | −0.03 | 0.11 | 0.08 |
| 305 (Example) | 0.63 | 0.57 | −0.01 | −0.02 | 0.08 | 0.01 |
| 306 (Example) | 0.63 | 0.56 | −0.02 | −0.01 | 0.08 | 0.01 |

TABLE 5-continued

| Sample No. | Sharpness (10 cycle/mm) R | Sharpness (10 cycle/mm) G | Storage Properties ($\Delta So_{.7}$) R | Storage Properties ($\Delta So_{.7}$) G | Rapid Process (Dmin) | Color Stain D (R) |
|---|---|---|---|---|---|---|
| 307 (Example) | 0.64 | 0.56 | −0.02 | −0.02 | 0.08 | 0.00 |
| 308 (Example) | 0.62 | 0.59 | −0.01 | −0.01 | 0.08 | 0.01 |
| 309 (Example) | 0.61 | 0.60 | −0.01 | −0.02 | 0.08 | 0.00 |
| 310 (Example) | 0.62 | 0.59 | −0.01 | −0 02 | 0.08 | 0.01 |
| 311 (Example) | 0.48 | 0.59 | −0.02 | −0.01 | 0.08 | 0.01 |
| 312 (Comp. Ex) | 0.48 | 0.46 | −0.13 | −0.05 | 0.10 | 0.11 |
| 313 (Comp. Ex) | 0.48 | 0.47 | −0.15 | −0.06 | 0.11 | 0.12 |
| 314 (Comp. Ex) | 0.49 | 0.46 | −0.16 | −0.08 | 0.11 | 0.11 |
| 315 (Comp. Ex) | 0.48 | 0.46 | −0.18 | −0.08 | 0.10 | 0.10 |
| 316 (Comp. Ex) | 0.48 | 0.46 | −0.35 | −0.07 | 0.11 | 0.12 |
| 317 (Comp. Ex) | 0.49 | 0.47 | −0.22 | −0.05 | 0.10 | 0.12 |
| 318 (Example) | 0.53 | 0.49 | −0.02 | −0.02 | 0.09 | 0.02 |
| 319 (Example) | 0.57 | 0.53 | −0.02 | −0.01 | 0.09 | 0.02 |
| 320 (Example) | 0.63 | 0.56 | −0.02 | −0.02 | 0.08 | 0.01 |
| 321 (Example) | 0.63 | 0.55 | −0.05 | −0.04 | 0.08 | 0.00 |
| 322 (Example) | 0.63 | 0.53 | −0.01 | −0.02 | 0.09 | 0.02 |
| 323 (Example) | 0.62 | 0.57 | −0.03 | −0.01 | 0.09 | 0.02 |
| 324 (Example) | 0.63 | 0.60 | −0.02 | −0.03 | 0.08 | 0.01 |
| 325 (Example) | 0.62 | 0.57 | −0.04 | −0.04 | 0.08 | 0.00 |
| 326 (Comp. Ex) | 0.49 | 0.50 | −0.03 | −0.02 | 0.19 | 0.00 |
| 327 (Comp. Ex) | 0.52 | 0.53 | −0.02 | −0.02 | 0.13 | 0.01 |
| 328 (Example) | 0.62 | 0.57 | −0.01 | −0.02 | 0.08 | 0.01 |
| 329 (Example) | 0.68 | 0.65 | −0.02 | −0.02 | 0.08 | 0.01 |

The values on the sharpness set forth in Table 5 were values measured as follows. The sample was exposed in close contact with a resolving power chart and then developed. The obtained image was measured on the sharpness using a microdensitometer through a red (R) filter and a green (G) filter. The obtained value is a value of CTF measured at 10 cycle/mm, and it can be said that the sharpness becomes higher as the value becomes larger.

The value on the storage properties is a value of change ($\Delta So_{.7}$) in the sensitivity (logE) measured at 40° C., 60% and a density of 0.7 after 4 weeks. As the value comes near to 0.001, the change of sensitivity becomes smaller, that is, the storage properties are excellent.

The value on the rapid processing properties is a value of the minimum density (D min) portion of the sample measured through a red filter (R) after the sample was subjected to the following process (first developing time: 15 seconds). As the value becomes smaller, the sample is more suitable for rapid processing.

The value on the color staining is a color density value (D(R)) of a cyan coupler on the R exposure portion (red color portion). As the value becomes larger, the color staining becomes larger, and the saturation of red color is reproduced with a small level.

The following has been confirmed from the results set forth in Table 5.

(i) From the results on the samples No. 301 to No. 304, it has been confirmed that for restraining the color stain to not more than 0.04 using conventional techniques, it is required that the thickness of the fifth layer is made larger than 1.0 in addition to using a color stain inhibitor represented by the formula (2). Even in this case, the sharpness of not less than 0.55 cannot be obtained.

(ii) Even in the case of using the conventionally known additives (Cpd-101, Cpd-102), that is, in the case of samples No. 312 to No. 317, the sharpness of not less than 0.55 cannot be obtained in spite of presence or absence of the color stain inhibitor and reduction of the film thickness.

From the results on the samples No. 304 to No. 310, it has been confirmed that the effect of the invention appears only when the compound of the formula (1a) or (1b) is used in combination with the compound of the formula (2) according to the invention and further the thickness of the fifth layer is made not more than 1.0 μm. That is, a sample which is excellent in storage properties, sharpness, rapid processing properties and color stain can be obtained.

From the results on the samples No. 318 to No. 321, it has been confirmed that the amount of the compound represented by the formula (1a) or (1b) is desired to be 0.4 to 400 mg/m$^2$. From the results on the samples No. 322 to No. 325, it has been confirmed that the amount of the compound represented by the formula (2) is desired to be 0.01 to 0.60 g/m$^2$. From the results on the samples No. 326 to No. 329, it has been confirmed that the thickness is desired to be not more than 1.0.

EXAMPLE 4

Each of the samples No. 301 to No. 329 was optically exposed and then subjected the following rapid processing. As a result, the similar results to those of Example 3 were obtained.

| Process | |
|---|---|
| First developing (black and white developing) | 40° C., 45 sec. |
| Basin washing | 38° C., 90 sec. |
| Reversal exposure | 100 lux, 30 sec. |
| Color developing | 40° C., 45 sec. |
| Basin washing | 38° C., 15 sec. |
| Bleach-fix | 38° C., 45 sec. |
| Washing (three-step cascade) | 38° C., 45 sec. |
| Drying | |

The washing liquid for each basin washing is daily replaced with new one.

The compositions of the processing liquids were the same as those of Example 3.

EXAMPLE 5

The sixth layer in the sample No. 301 of Example 3 described in Japanese Patent Provisional Publication No. 2(1990)-00854 was replaced with the fifth layer of the present invention (No. 101–No. 129). As a result, the similar results to those described in the above were obtained.

We claim:

1. A silver halide color photographic material comprising a support, a blue sensitive layer, a green sensitive layer and a red sensitive layer and at least one non-light-sensitive layer, said non-light-sensitive layer being an intermediate layer arranged among the blue, green and red sensitive layers, wherein at least one of the non-light-sensitive intermediate layer contains a compound represented by the formula (1a) or (1b):

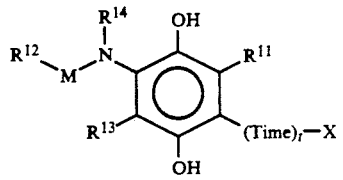

(1a)

-continued

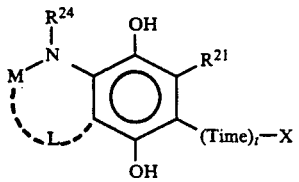

(1b)

in which $R^{12}$ is an aliphatic group, an aromatic group or a heterocyclic group; M is —N($R^{15}$)CO—, —OCO— or —N($R^{15}$)$SO_2$—; each of $R^{14}$, $R^{15}$ and $R^{24}$ independently is hydrogen, an alkyl group or an aryl group; L is a divalent linking group necessary for forming a 5, 6 or 7-membered ring; each of $R^{11}$, $R^{13}$ and $R^{21}$ independently is hydrogen or a substituent group of the hydroquinone nucleus; Time is a group which is released from the oxidation product of the hydroquinone nucleus to further release X; X is a development inhibitor; and t is 0 or 1.

2. The photographic material as claimed in claim 1, wherein the blue, green or red sensitive layer arranged nearest under the non-light-sensitive intermediate layer comprises two or more silver halide emulsion layers, said emulsion layers being different from each other with respect to the strength of the sensitivity, and the spectral sensitivities of said emulsion layers being the same with respect to blue, green or red, and the lowest sensitive emulsion layer is arranged between the highest sensitive emulsion layer and the non-light-sensitive intermediate layer.

3. The photographic material as claimed in claim 1, wherein the thickness of the non-light-sensitive intermediate layer is less than 0.8 μm, and the blue, green or red sensitive layer or the non-light-sensitive intermediate layer further contains a compound represented by the formula (2):

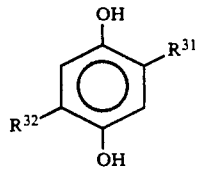

(2)

in which $R^{31}$ and $R^{32}$ independently is a substituent group of the hydroquinone nucleus.

4. The photographic material as claimed in claim 3, wherein the compound represented by the formula (2) is contained in the non-light-sensitive intermediate layer.

5. The photographic material as claimed in claim 1, the non-light-sensitive intermediate layer containing the compound represented by the formula (1a) or (1b) is arranged between the green sensitive layer and the red sensitive layer.

6. The photographic material as claimed in claim 1, wherein each of $R^{11}$ and $R^{21}$ in the formulas (1a) and (1b) is hydrogen, an alkylthio group, an arylthio group, an alkoxy group, an aryloxy group, an amido group, a sulfonamido group, an alkoxycarbonylamino group, an ureido group, a carbamoyl group, an alkoxycarbonyl group, a sulfamoyl group, a sulfonyl group, cyano, an acyl group, a heterocyclic group or a group represented by —(Time)$_t$—X.

7. The photographic material as claimed in claim 1, wherein each of $R^{11}$ and $R^{21}$ in the formulas (1a) and (1b) is hydrogen, an alkylthio group, an alkoxy group, an amido group, a sulfonamido group, an alkoxycarbonylamino group, an ureido group a carbamoyl group, an alkoxycarbonyl group, a sulfamoyl group, cyano or a group represented by —(Time)$_t$—X.

8. The photographic material as claimed in claim 1, wherein $R^{13}$ in the formula (1a) is hydrogen, an alkylthio group, an arylthio group, an alkoxy group, an aryloxy group, an amido group, a sulfonamido group, an alkoxycarbonylamino group, an ureido group or a group represented by —(Time)$_t$—X.

9. The photographic material as claimed in claim 1, wherein $R^{13}$ in the formula (1a) is hydrogen, an alkylthio group, an alkoxy group, an amide group, a sulfonamide group, an alkoxycarbonylamino group, a ureido group or a group represented by —(Time)$_t$—X.

10. The photographic material as claimed in claim 1, wherein the compound represented by the formula (1a) or (1b) is contained in the non-light-sensitive intermediate layer in an amount of $10^{-7}$ mol/m$^2$ to $10^{-3}$ mol/m$^2$.

11. The photographic material as claimed in claim 3, wherein each of $R^{31}$ and $R^{32}$ in the formula (2) independently is an alkyl group, an aryl group, an alkylthio group, an arylthio group, an alkoxy group, an aryloxy group, an amido group, a sulfonamido group, an alkoxycarbonylamino group, an ureido group, a sulfonyl group, a sulfoalkyl group, carboxyl, a carboxyalkyl group or an alkylsulfonyl group.

12. The photographic material as claimed in claim 3, wherein the photographic material is a color reversal sensitive material.

* * * * *